US006226803B1

(12) United States Patent
Tanaka

(10) Patent No.: US 6,226,803 B1
(45) Date of Patent: May 8, 2001

(54) HELMET

(75) Inventor: Haruo Tanaka, Ichikawa (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 09/352,502

(22) Filed: Jul. 10, 1999

(30) Foreign Application Priority Data

Jul. 16, 1998 (JP) ..... 10-218533

(51) Int. Cl.[7] ..... A42B 3/18
(52) U.S. Cl. ..... 2/424
(58) Field of Search ..... 2/410, 411, 421, 2/422, 424, 425, 10

(56) References Cited

U.S. PATENT DOCUMENTS 4,766,615 * 8/1988 Morin et al. ..... 2/421
4,769,857 * 9/1988 Cianfanelli et al. ..... 2/424
4,794,652 * 1/1989 Piech Von Planta et al. ..... 2/414
5,084,918 * 2/1992 Breining et al. ..... 2/424
5,813,048 * 9/1998 Thom ..... 2/6.5

FOREIGN PATENT DOCUMENTS

72767 * 2/1983 (EP) .

* cited by examiner

*Primary Examiner*—Michael A. Neas
(74) *Attorney, Agent, or Firm*—Jones, Day, Reavis & Pogue

(57) ABSTRACT

A helmet includes a common unlocking member for commonly unlocking a pair of right and left locking mechanisms that lock a subsidiary cap portion at a lower position where it covers the chin of a helmet wearer. A common tractive flexible wire transmits forward unlocking movement of the unlocking member commonly to movable locking members of the pair of right and left locking mechanisms. The intermediate portion of the common tractive flexible wire is engaged by the wire engaging portion of the unlocking member. With this helmet, in spite that the mechanism for unlocking the locked subsidiary cap portion is comparatively simple, the unlocking mechanisms can be operated quickly and smoothly.

23 Claims, 12 Drawing Sheets

HELMET

TECHNICAL FIELD

The present invention relates to a helmet which has a cap-shaped head protecting body, worn by the helmet wearer such as the rider of a motor cycle to protect his/her head, and having a cap-shaped main cap portion and a subsidiary cap portion attached to the main cap portion to be substantially vertically movable so as to selectively cover the chin of the helmet wearer.

BACKGROUND OF THE INVENTION

As vehicle helmets worn by the rider of a motor cycle or the like, a full-face-type helmet and a jet-type helmet are conventionally known. In the full-face-type helmet, a chin cover for covering the chin of the helmet wearer is integrally formed with the head protecting body. In the jet-type helmet, no chin cover is formed on the head protecting body so as to expose the face of the helmet wearer almost entirely. Another full-face-type helmet (to be referred to as a "full-face-type helmet serving also as a jet-type helmet" hereinafter) is also conventionally known. In this full-face-type helmet, the head protecting body is formed of a main cap portion having almost the same shape as that of the head protecting body of a jet-type helmet, and a subsidiary cap portion attached to the main cap portion to be substantially vertically pivotal so as to selectively cover the chin of the helmet wearer, so that the helmet can have the functions of both a full-face-type helmet and a jet-type helmet.

In the conventional full-face-type helmet serving also as the jet-type helmet, when the subsidiary cap portion is at the lower position, it serves as a chin covering means. When the subsidiary cap portion is at the upper position, a large window formed in the main cap portion is opened, and the head protecting body accordingly has no chin covering means, in the same manner as in the jet-type helmet. When the wearer wearing the full-face-type helmet serving also as the jet-type helmet is driving a motor cycle at high speed, the helmet is worn with its subsidiary cap portion being lowered to the lower position, in order to prevent a large wind pressure from acting on the wearer's chin and its vicinity. The helmet is provided with a subsidiary cap portion locking mechanism for locking the subsidiary cap portion at the lower position with respect to the main cap portion, so that the subsidiary cap portion does not undesirably move upward by a large impact or wind pressure during high-speed driving. The subsidiary cap portion is provided with an unlocking means or member in order to unlock the subsidiary cap portion locked at the lower position by the subsidiary cap portion locking mechanism.

Such a conventional full-face-type helmet serving also as the jet-type helmet is disclosed in European Patent No. 518,178 as well. In the helmet disclosed in this reference (to be referred to as "the first known helmet" hereinafter), when a release lever serving as the unlocking member is pressed for unlocking, a force which moves the subsidiary cap portion from the lower position to the upper position automatically acts on the subsidiary cap portion. In other words, when the release lever is pressed upward, the subsidiary cap portion locked at the lower position is unlocked. Therefore, when the release lever is pressed upward to unlock the locked subsidiary cap portion, the subsidiary cap portion locked by the locking mechanism is unlocked. Also, the subsidiary cap portion can be started to move from the lower position to the upper position by only successively pressing the release lever. Hence, the wearer can unlock the locked subsidiary cap portion and move the unlocked subsidiary cap portion upward quickly and continuously by only pressing the release lever.

In the first known helmet as described above, assume that, while the wearer drives the motor cycle at high speed, for example, he erroneously presses the release lever upward so as to slightly move a shield plate (attached to the subsidiary cap portion to be able to open/close the window opening formed in the front surface of the head protecting body of the helmet), so that the window opening closed by the shield plate may be slightly opened. Alternatively, assume that a foreign matter accidentally abuts against the release lever from below. Then, the subsidiary cap portion locked at the lower position is unlocked, and undesirably moves upward from the lower position for a certain degree. A large wind pressure then can directly act on the wearer's chin, causing inconveniences for the wearer in driving the motor cycle.

In the first known helmet as described above, when an operation lever connected to the release lever through a wire causes a movable locking member made of a spring member to move forward against the spring force, the locking mechanism is unlocked. In spite that the structure of the mechanism for unlocking the subsidiary cap portion locked by the locking mechanism is not very simple, the subsidiary cap portion might not be unlocked or inversely locked by the locking mechanism quickly and smoothly.

The conventional full-face-type helmet serving also as the jet-type helmet, as described above, is disclosed in German Patent Laid-Open No. 19,612,724 as well. In the helmet (to be referred to as "the second known helmet" hereinafter) disclosed in this reference, when the release tap serving as the unlocking means is pressed for unlocking, a force opposite to a force that moves the subsidiary cap portion from the lower position to the upper position acts on the subsidiary cap portion. In other words, when the release tap is pressed downward, the subsidiary cap portion locked at the lower position is unlocked. Even when the release tap is continuously pressed, it is not sufficient to move the subsidiary cap portion from the lower position to the upper position. Therefore, when the wearer is driving the motor cycle at high speed, the subsidiary cap portion does not move upward from the lower position erroneously or accidentally, and accordingly large wind pressure will not substantially, directly act on the helmet wearer's chin.

In the second known helmet as described above, the movable locking member is constituted by an arcuated operation lever formed with the release tap at its central portion. The operation lever is pivotally, axially supported on the auxiliary cap portion at the right and left portions. Also, a pair of right and left engaging recesses are formed in the right and left end portions of the operation lever. When a pair of right and left lock pins provided to the main cap portion relatively engage with these engaging recesses, the subsidiary cap portion is locked on the main cap portion. When the helmet wearer holds the release tap with his fingers and moves it downward, the operation lever pivots forward to disengage the lock pins relatively from the engaging recesses, thereby unlocking the locked subsidiary cap portion. Therefore, in the second known helmet as well, in spite that the structure of the mechanism for unlocking the subsidiary cap portion locked by the locking mechanism is not very simple, the subsidiary cap portion might not be unlocked or inversely locked by the locking mechanism quickly and smoothly.

SUMMARY OF THE INVENTION

The present invention is directed to correcting the drawbacks described above of the conventional full-face-type helmet serving also as the jet-type helmet with a very simple arrangement very effectively.

It is, therefore, the main object of the present invention to provide a helmet in which, in spite that the mechanism for unlocking the subsidiary cap portion locked on the main cap portion with the locking mechanism is comparatively simple, the unlocking operation and the opposite locking operation can be performed quickly and smoothly.

It is another object of the present invention to provide a helmet with which when the wearer is driving a motor cycle at high speed, the subsidiary cap portion will not move upward from the lower position erroneously or accidentally, and large wind pressure will not substantially, directly act on the helmet wearer's chin.

Therefore, the present invention relates to a helmet including a cap-shaped head protecting body to be worn by a helmet wearer on his/her head, the head protecting body having a main cap portion and a subsidiary cap portion attached to the main cap portion to be substantially vertically movable so as to selectively cover a chin of the helmet wearer, the head protecting body being provided with first and second locking mechanisms for respectively locking left and right sides of the subsidiary cap portion with respect to the main cap portion when the subsidiary cap portion is at a lower position to cover the chin, and the head protecting body being also provided with a common unlocking member which is operated forward to commonly unlock the subsidiary cap portion locked by the first and second locking mechanisms. This helmet is provided with a common tractive flexible wire for commonly transmitting forward movement of the unlocking member to first and second movable locking members of the first and second locking mechanisms. One end portion of the wire is connected to the first movable locking member, and the other end portion of the wire is connected to the second movable locking member. The unlocking member is provided with a wire engaging portion, and an intermediate portion of the wire is engaged by the wire engaging portion.

The above and other objects, features and advantages of this invention will become readily apparent from the following detailed description thereof which is to be read in connection with the accompanying drawings.

DETAILED DESCRIPTION OF THE INVENTION

The preferred embodiments in which the present invention is applied to a full-face-type helmet serving also as a jet-type helmet will be described with reference to the accompanying drawings.

First Embodiment

The first embodiment in which the present invention is applied to a full-face-type helmet serving also as a jet-type helmet will be described first with reference to FIGS. 1 to 9.

Figure 1:
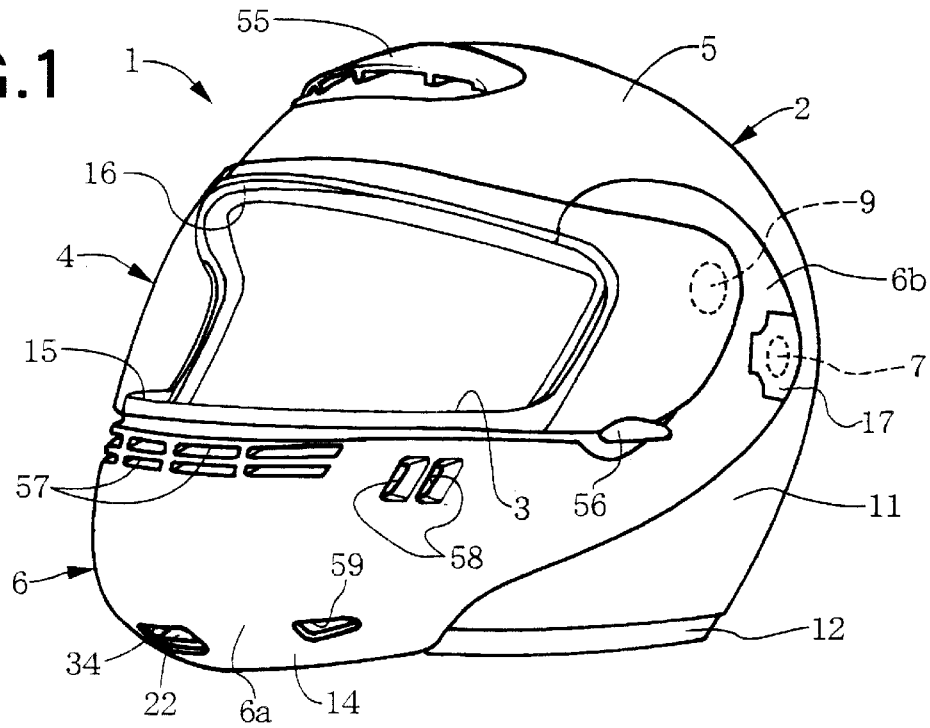
FIG. 1 is a perspective view of the entire portion of a helmet in an ordinary worn state in the first embodiment in which the present invention is applied to a full-face-type helmet serving also as a jet-type helmet.
Figure 2:
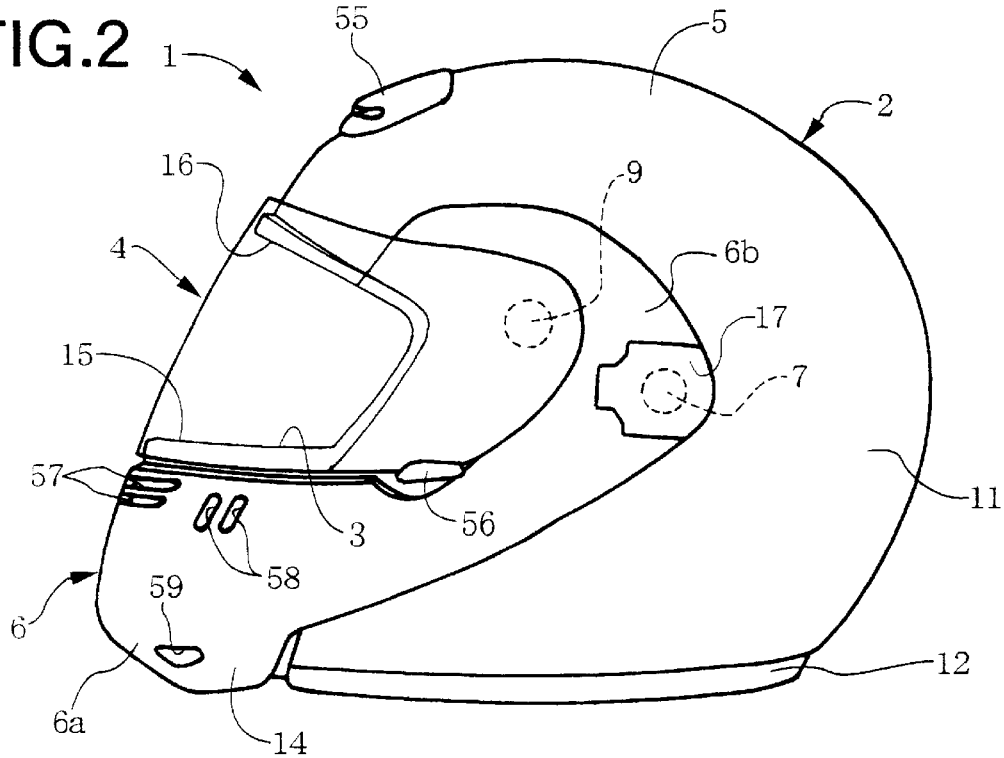
FIG. 2 is a right side view of the entire portion of the helmet shown in FIG. 1 in an ordinary worn state.
Figure 3:
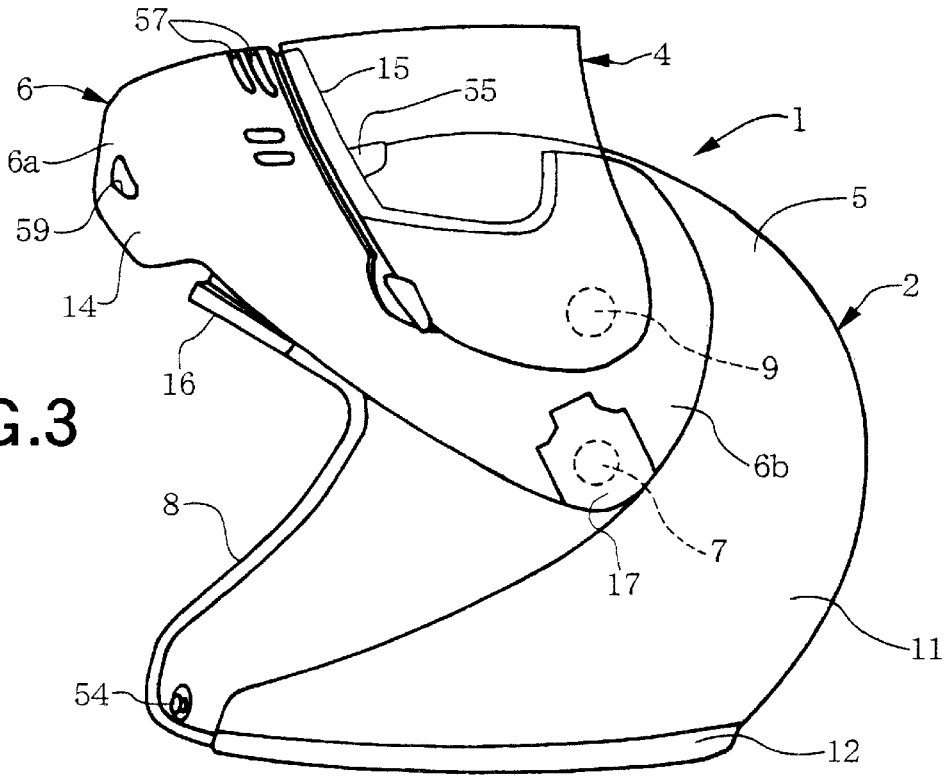
FIG. 3 is a right side view of the entire portion of the helmet shown in FIG. 1 with the subsidiary cap portion raised.

As shown in FIGS. 1 to 3, a full-face-type helmet 1 serving also as a jet-type helmet is made up of a full-face-type cap-shaped head protecting body 2, a shield plate 4, and a pair of right and left chin straps (not shown). Note that the full-face-type cap-shaped head protecting body 2 is to be worn on the head of a helmet wearer, e.g., the rider of a motor cycle, and serves as a jet-type head protecting body as well. The shield plate 4 can open/close a window opening 3 formed in the front surface of the full-face-type head protecting body 2 to oppose the portion between the forehead and chin of the wearer (i.e., almost the central portion of the face). The chin straps are attached to the inner surface portions of the full-face-type head protecting body 2.

As is conventionally known, the head protecting body 2 has a main cap portion 5 and a subsidiary cap portion 6. The main cap portion 5 can have almost the same shape as that of the cap portion of a jet-type helmet. The subsidiary cap portion 6 is attached to the main cap portion 5 on the right and left sides with a pair of right and left attaching screws 7 serving as axial support means, so as to be reciprocally pivotal. Accordingly, a large window 8 is formed in the main cap portion 5 to be defined by a large notch extending upward from the lower end of the front surface of the main cap portion 5. As is conventionally known, the subsidiary cap portion 6 has a chin cover 6*a* and a pair of right and left ears 6*b*.The chin cover 6*a* is arcuated to expand forward. The ears 6*b* extend from the right and left ends of the chin cover 6*a* and are axially supported on the right and left sides of the main cap portion 5 with a pair of right and left attaching screws 7 to be reciprocally movable. The subsidiary cap portion 6 is formed with a large window 15 defined by a large notch extending downward from the upper end of its front surface. When the subsidiary cap portion 6 pivots downward with respect to the main cap portion 5 to be located at the lower position (the state shown in FIGS. 1 and 2), it serves as a chin covering means for covering the wearer's chin to close the lower portion of the window 8. Hence, the upper portion of the window 8 defines the window opening 3. The window opening 3 is formed of a region surrounded by the rim of the window 8 of the main cap portion 5 and the rim of the window 15 of the subsidiary cap portion 6.

As is conventionally known, the shield plate 4 can be made of a transparent or translucent hard material such as polycarbonate or another type of hard synthetic resin. The shield plate 4 is reciprocally pivotally attached to the subsidiary cap portion 6 at the right and left sides with a pair of right and left attaching screws 9 serving as axial support means. When the subsidiary cap portion 6 is at the lower position to serve as the chin covering means (the state shown in FIGS. 1 and 2), the shield plate 4 closes the window opening 3 at the backward position (i.e., the lower position); and opens the window opening 3 at the forward position (i.e., the upper position).

As is conventionally known, the main cap portion 5 can be made up of a jet-type outer shell 11, a rim member 12 having a substantially U-shaped section, and a backing member (not shown) for the main cap portion. The outer shell 11 forms the outer wall of the main cap portion 5. Note that the rim member 12 has a substantially E-shaped section at the upper end portion of the window 8. The rim member 12 has a substantially U-shaped section at the reminding portion of the window 8 except the upper end portion and is fixed to the outer shell 11 throughout the end portion of the outer shell 11 with an adhesive or the like. The backing member is brought into contact with the outer shell 11 to be fixed to it in contact with the inner surface of the outer shell 11 with an adhesive or the like. As is conventionally known, the outer shell 11 can be made of a composite material. More specifically, the outer shell 11 can be formed by lining the inner surface of a strong shell body made of a hard synthetic resin, e.g., FRP, with a flexible sheet such as an unwoven fabric. As is conventionally known, a portion of the rim member 12 having the substantially U-shaped section can be made of a soft synthetic resin such as foamed vinyl chloride or synthetic rubber. A portion of the rim member 12 having the substantially E-shaped section can be made of an elastic material with high flexibility such as synthetic rubber.

As is conventionally known, the backing member for the main cap portion can be constituted by an impact absorbing liner for the main cap portion, attached to the inner surface of the outer shell 11 for the main cap portion with an adhesive or the like, and a blockish inside pad for the main cap portion and a backing cover for the main cap portion which are sequentially attached to cover substantially the inner surface of the impact absorbing liner. The impact absorbing liner for the main cap portion can be made of a material with appropriate rigidity and plasticity such as foamed polystyrene or another synthetic resin. The blockish inside pad for the main cap portion can be made of one or a plurality of elastic materials with high flexibility such as urethane foam or another synthetic resin, and a porous unwoven fabric covering the inner and outer surfaces of the elastic material(s) to form a bag. The backing cover for the main cap portion can be made of a porous unwoven fabric formed by laminating layers, consisting of an elastic material with high flexibility such as urethane foam or another synthetic resin, on the surface opposing the impact absorbing liner for the main cap portion.

As is conventionally known, the subsidiary cap portion 6 can be made up of an outer shell 14, a rim member 16 having a substantially E-shaped section, and a backing member (not shown) for the subsidiary cap portion. The outer shell 14 forms the outer wall of the subsidiary cap portion 6. The rim member 16 is fixed to part (i.e., the end portion of the window 15) of the end portion of the outer shell 14 with an adhesive or the like. The backing member for the subsidiary cap portion is brought into contact with the outer shell 14 to be fixed to it in contact with the inner surface of the outer shell 14 with an adhesive or the like. As is conventionally known, the outer shell 14 and the rim member 16 having the substantially E-shaped section can be made of the same materials as those described above concerning the outer shell 11 for the main cap portion and the rim member 12 having substantially the E-shaped section. A pair of right and left cover members 17 for externally covering the pair of right and left attaching screws 7 are attached to the outer shell 14 to be reciprocally pivotal about their front edge portions as the fulcrums. When the cover members 17 are outwardly pivoted forward through about 90°, the heads of the attaching screws 7 are exposed. Inversely, when the cover members 17 are pivoted backward, the heads of the attaching screws 7 are covered by the cover members 17, as shown in FIGS. 1 to 3.

As is conventionally known, the backing member for the subsidiary cap portion can be constituted by an impact absorbing liner for the subsidiary cap portion, and a backing cover for the subsidiary cap portion, attached to the inner surface of the impact absorbing liner to substantially cover it. The impact absorbing liner for the subsidiary cap portion is attached to the inner surface of the outer shell 14 for the subsidiary cap portion with an adhesive or the like, and can be made of a material with appropriate rigidity and plasticity such as foamed polyurethane rubber or another synthetic resin. The backing cover for the subsidiary cap portion can be made of synthetic leather or another cloth made of a synthetic resin such as vinyl chloride resin, or another fabric.

A pair of right and left subsidiary cap portion locking mechanisms 21 are incorporated in the head protecting body 2. Each of the pair of subsidiary cap portion locking mechanisms 21 has a function of locking the subsidiary cap portion 6 at the lower position with the head protecting body 2, as is clearly shown in FIG. 4. The pair of subsidiary cap portion locking mechanisms 21 are unlocked by a common release button 22 serving as an unlocking means or member.

Figure 7:
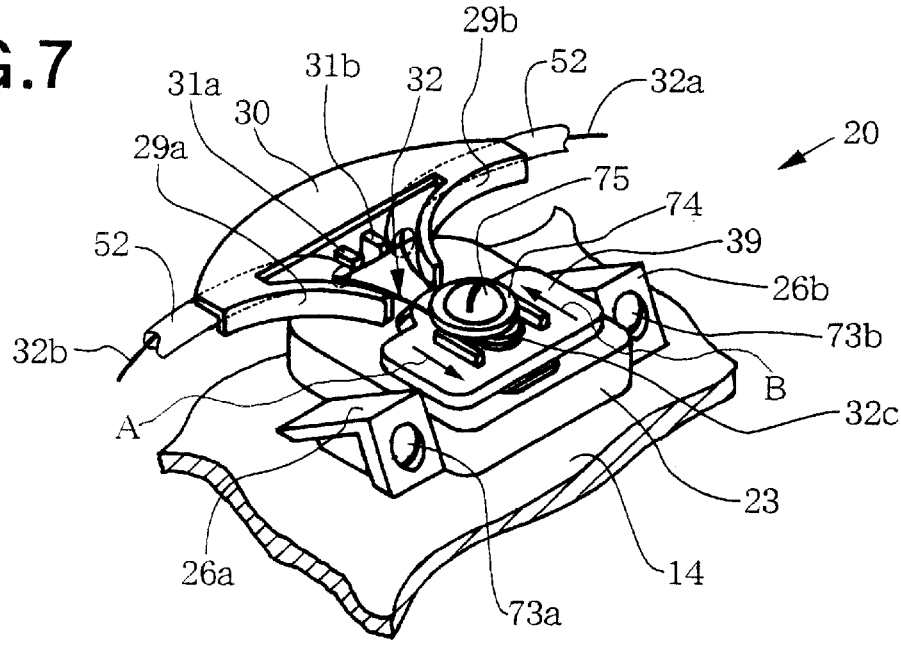
FIG. 7 is a perspective view of the release button and a holding mechanism for it shown in FIG. 4.
Figure 9:
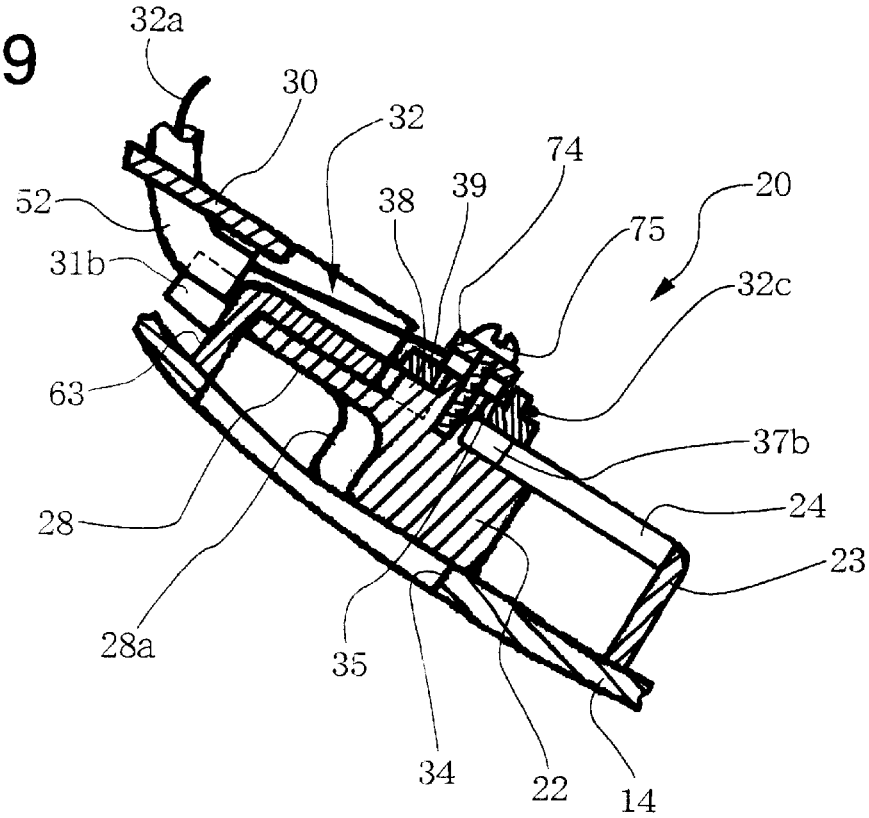
FIG. 9 is a longitudinal sectional view, taken along the center, of the release button and the holding mechanism for it shown in FIG. 7.
Figure 8:
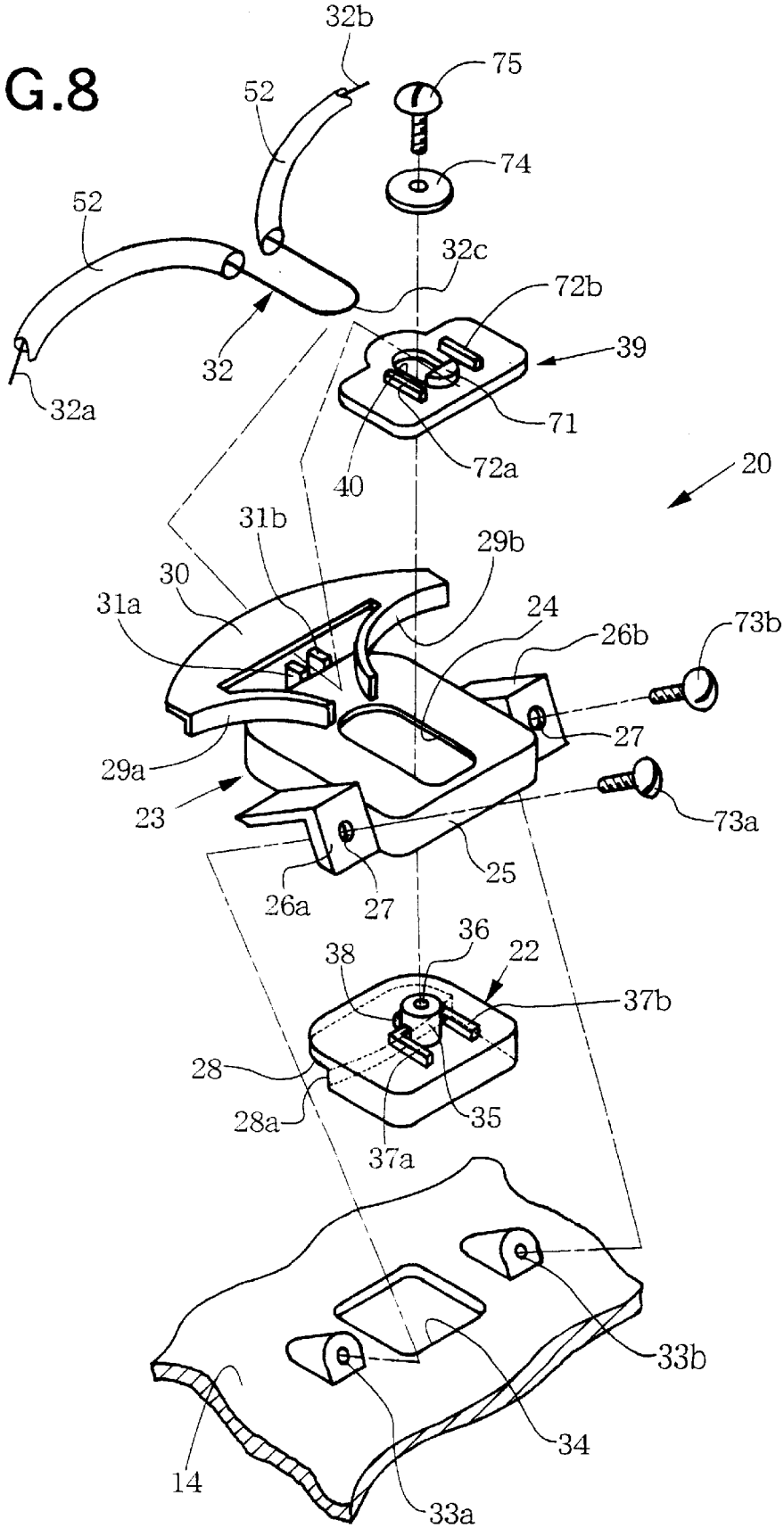
FIG. 8 is an exploded perspective view of the release button and the holding mechanism for it shown in FIG. 7.
Figure 10:
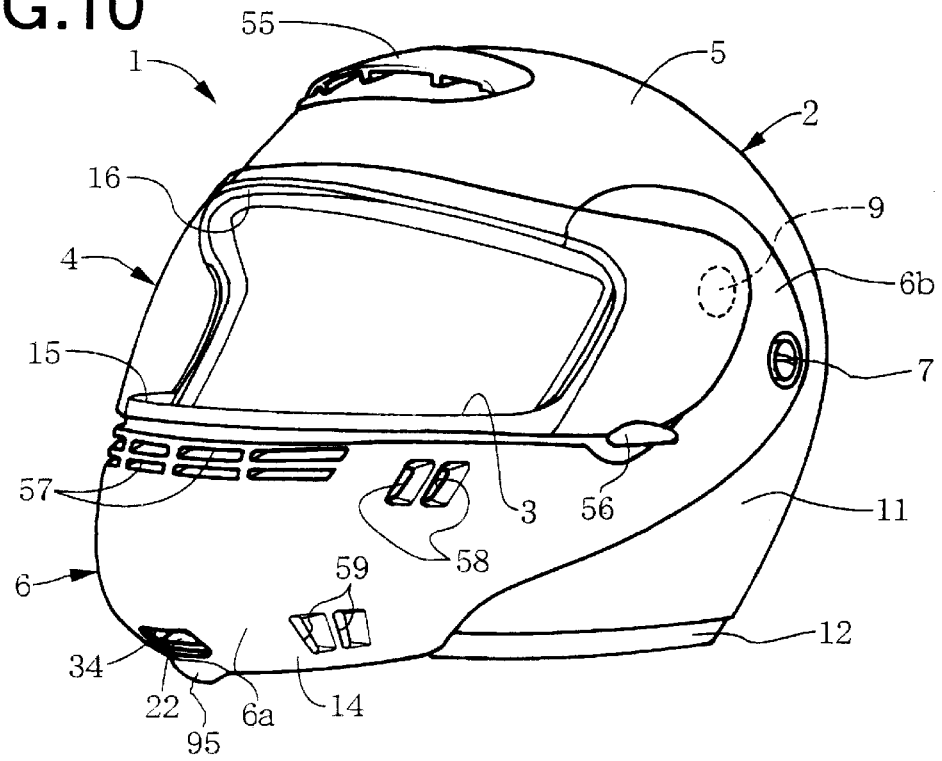
FIG. 10 is a perspective view of the entire portion of a helmet in an ordinary worn state in the second embodiment in which the present invention is applied to a full-face-type helmet serving also as a jet-type helmet.

As shown in FIGS. 7 to 9, the release button 22 is held by a button holding mechanism 20 serving as an unlocking member holding mechanism at substantially the central portion of the subsidiary cap portion 6 (i.e., a portion opposing the distal end of the wearer's chin) to be linearly, reciprocally slidable. The button holding mechanism 20 is constituted by the outer shell 14 for the subsidiary cap portion, and a button holding member 23. The button holding member 23 is made of an appropriate material such as a synthetic resin, e.g., polyacetal resin or ABS resin. The button holding member 23 has a member main body 25. The member main body 25 has an elongated hole 24 extending at substantially the central portion of its upper surface in the back-and-forth direction, and forms a substantially box-like lid. A pair of left and right substantially V-shaped attached pieces 26*a* and 26*b* are formed on the left and right sides of the member main body 25 by, e.g., monolithic molding. The attached pieces 26*a* and 26*b* respectively have screw engaging holes 27. A guide 30 is formed near the front end of the upper surface of the member main body 25 by, e.g., monolithic molding. The guide 30 has a pair of left and right arcuated pieces 29*a* and 29*b* extending outwardly to the left and right, respectively. A pair of left and right subsidiary guide plates 31*a* and 31*b* are formed on the front end face of the member main body 25 by, e.g., monolithic molding. A pair of left and right attaching bosses 33*a* and 33*b* for attaching the button holding member 23 are formed at substantially the central portion of the outer shell 14 for the subsidiary cap portion (i.e., a portion opposing the distal end of the wearer's chin) by, e.g., monolithic molding. A finger-inserting aperture 34 is formed between the pair of attaching bosses 33*a* and 33*b*.

As shown in FIGS. 7 and 8, the release button 22 is formed of an appropriate material such as a synthetic resin, e.g., nylon 6 or ABS resin, to have a substantially blockish shape. A finger-inserting notched portion 28 is formed in one half of the lower surface of the release button 22. The notched portion 28 forms, in the release button 22, a press surface 28*a* (i.e., a surface substantially perpendicularly intersecting the aperture 34) used for pressing the release button 22 with a finger. A columnar portion 35 having a screw hole 36 is formed on substantially the central portion of the upper surface of the release button 22 by, e.g., monolithic molding. A pair of left and right substantially L-shaped arms 37*a* and 37*b*, and a protrusion 38, all of which extend from the columnar portion 35, are formed on the upper surface of the release button 22 by, e.g., monolithic molding.

As shown in FIGS. 7 and 8, a wire attaching member 39 serving as a wire body attaching member attached and fixed to the release button 22 is formed of an appropriate material such as a synthetic resin, e.g., nylon 6 or ABS resin, to have a substantially platelike shape. An elongated hole 40 extending in the back-and-forth direction is formed at substantially the central portion of the attaching member 39. A substantially semicircular wire engaging portion 71 is formed on a surface of the attaching member 39 opposite to the outer shell 14 by, e.g., monolithic molding, to be near the rear end of the elongated hole 40. A pair of left and right projecting ridges 72*a* and 72*b* are formed on the left and right sides of the wire engaging portion 71 by, e.g., monolithic molding.

The release button 22 is accommodated in the button holding mechanism 20, constituted by the outer shell 14 for the subsidiary cap portion and the button holding member 23, to be linearly reciprocally slidable. To accommodate the release button 22, first, the release button 22 is fitted in the button holding member 23 to be linearly reciprocally slidable. When fitting the release button 22, the columnar portion 35, the pair of left and right arms 37*a* and 37*b*, and the protrusion 38 of the release button 22 are inserted in the elongated hole 24 of the button holding member 23. In this case, the pair of arms 37*a* and 37*b* are held to be linearly reciprocally slidable along the left and right rims of the elongated hole 24. The right and left side surfaces and upper surface of the release button 22 are also held to be linearly reciprocally slidable along the left and right inner surfaces and lower surface of the member main body 25 of the button holding member 23.

Subsequently, the button holding member 23 fitted with the release button 22 is attached and fixed to the outer shell 14 for the subsidiary cap portion. A pair of left and right attaching screws 73*a* and 73*b* inserted in the screw engaging holes 27 of the attached pieces 26*a* and 26*b* are screwed and fixed in the pair of left and right attaching bosses 33*a* and 33*b* of the outer shell 14 for the subsidiary cap portion, attaching and fixing the member 23. Accordingly, the release button 22 is reciprocally slidable with respect to the button holding member 23 in directions indicated by arrows A and B in FIGS. 4 and 7.

The wire attaching member 39 is attached and fixed to the release button 22. An attaching screw 75 is inserted in a washer 74 and the elongated hole 40 of the wire attaching member 39, and the attaching screw 75 is then screwed and fixed in the screw hole 36 of the columnar portion 35 of the release button 22, thereby attaching and fixing the member 39. In this case, the washer 74 is placed on the wire engaging portion 71 and the pair of left and right projecting ridges 72*a* and 72*b* of the wire attaching member 39. The wire attaching member 39 is placed on the pair of left and right arms 37*a* and 37*b* and the protrusion 38 of the release button 22.

When the attaching screw 75 is slightly screwed into the screw hole 36, an intermediate portion (in this case, substantially the central portion) 32*c* of a tractive wire 32, serving as a tractive flexible wire and made of a metal or the like, is hooked on the substantially arcuated portion of the wire engaging portion 71 of the wire attaching member 39 to form substantially a U-letter shape, and thereafter the attaching screw 75 is screwed into the screw hole 36 to fix the wire attaching member 39. In this case, before screwing and fixing, the wire attaching member 39 is linearly moved back and forth by utilizing the elongated hole 40, so that the attaching position in the back-and-forth direction of the wire attaching member 39 with respect to the release button 22 can be adjusted. This adjusts the tautness of the tractive wire 32 to remove the unnecessary slack of the tractive wire 32. The left and right portions of the tractive wire 32 that are directly continuous to the substantially U-shaped intermediate portion 32*c* are wound on the pair of left and right arcuated pieces 29*a* and 29*b*. The tractive wire 32 is used commonly by the pair of right and left subsidiary cap portion locking mechanisms 21. More specifically, the tractive wire 32 has a pair of left and right wire portions 32*a* and 32*b* continuous to the two ends of the U-shaped intermediate portion 32*c*. The wire portion 32*a* (to be referred to as the "tractive wire 32*a*" hereinafter) on the right side (i.e., on right side of the front surface of the helmet 1; this applies to the following description) is used by the right subsidiary cap portion locking mechanism 21. The wire portion 32*b* (to be referred to as the "tractive wire 32*b*" hereinafter) on the left side (i.e., on left side of the front surface of the helmet 1; this applies to the following description) is used by the left subsidiary cap portion locking mechanism 21. Since the right and left subsidiary cap portion locking mechanisms 21 are symmetric, a description will be made concerning the right subsidiary cap portion locking mechanism 21 hereinafter with reference to FIGS. 4 to 6, and a description on the left subsidiary cap portion locking mechanism 21 will be omitted.

Figure 4:
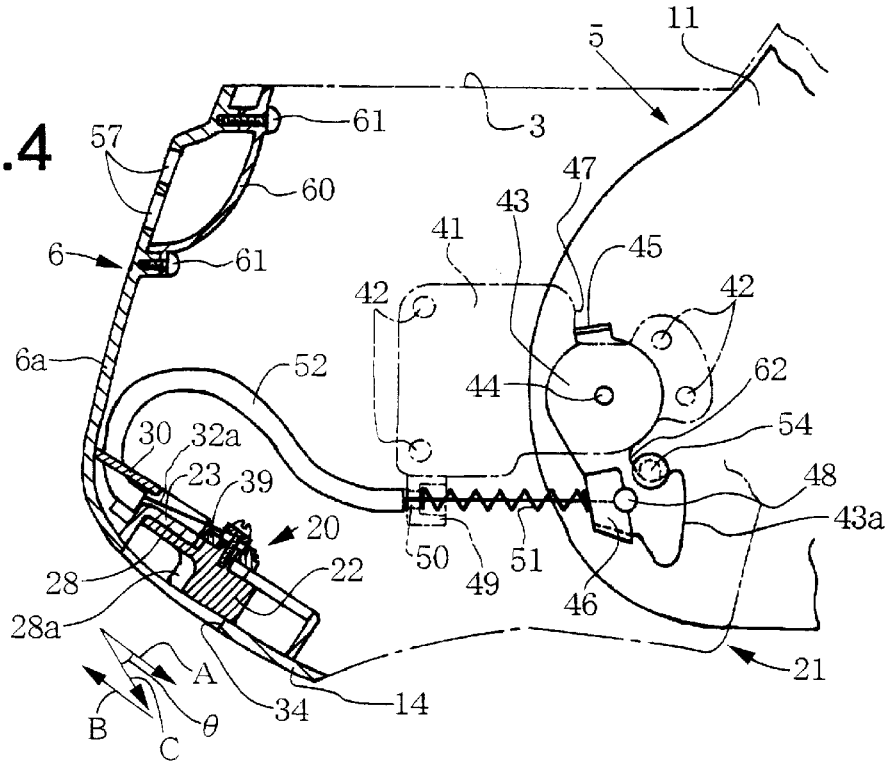
FIG. 4 is a longitudinal sectional partial view, taken along the center, of the helmet shown in FIG. 2, which explains the subsidiary cap portion locking mechanism and from which the backing member and rim member for the subsidiary cap portion are omitted.
Figure 5:
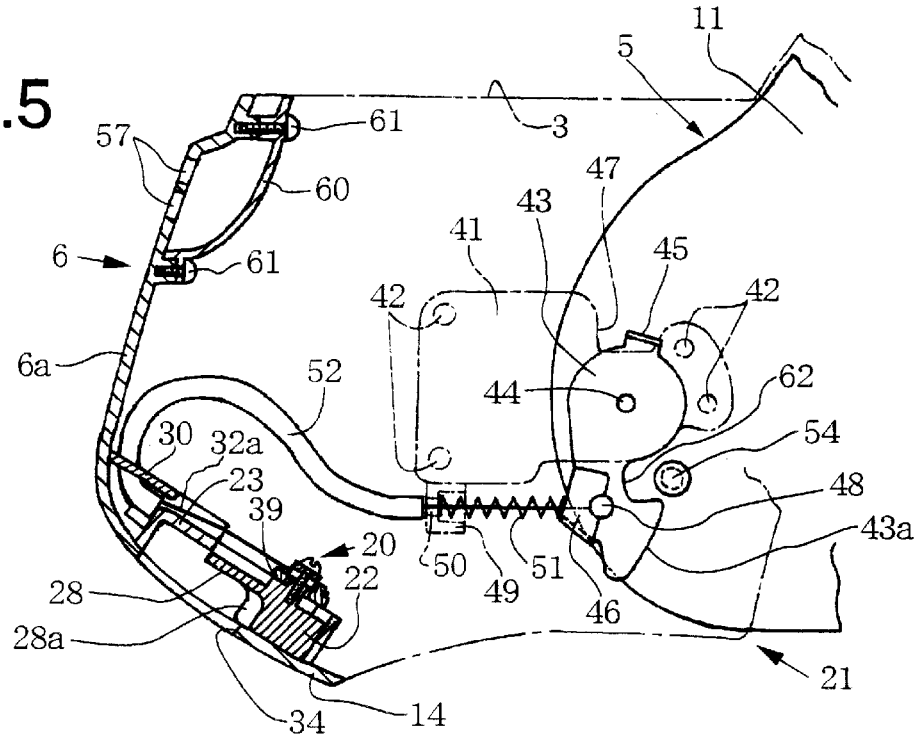
FIG. 5 is a view similar to FIG. 4, showing a state the release button is depressed.
Figure 6:
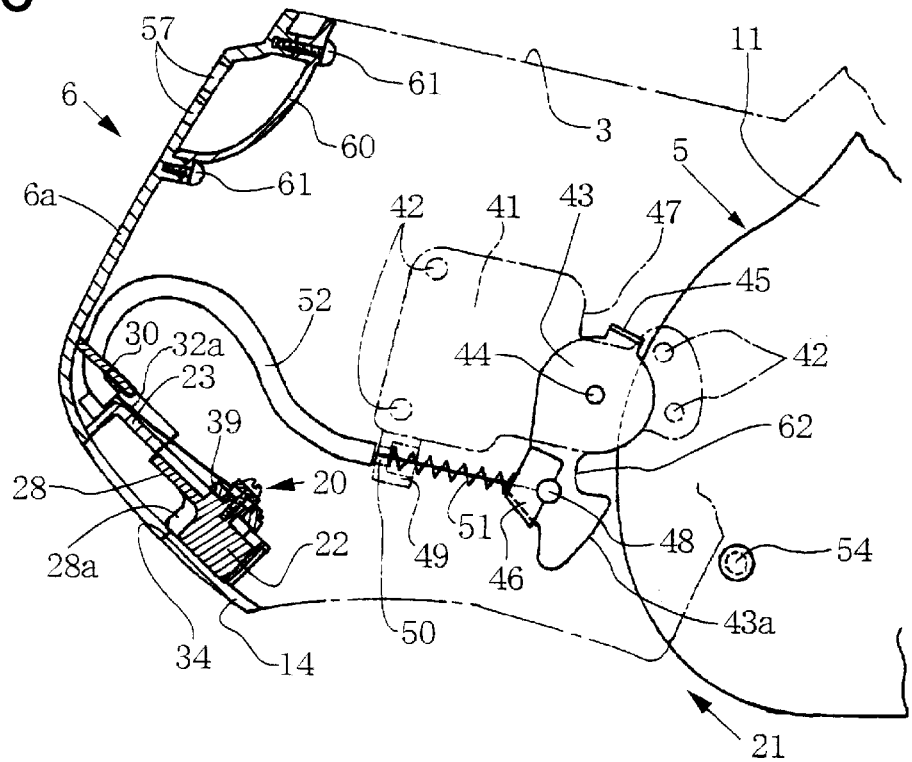
FIG. 6 is a view similar to FIG. 4, showing a state wherein the subsidiary cap portion is slightly raised from the state shown in FIG. 5.

Referring to FIGS. 4 to 6, an attaching base 41 made of an appropriate material such as a metal like stainless steel, or a synthetic resin like ABS resin, is attached and fixed to the inner surface of the right ear 6*b* of the subsidiary cap portion 6 with an attaching screw 42. A lock lever 43 serving as a movable locking means or member is axially supported on the attaching base 41 with an attaching screw 44 to be reciprocally pivotal. A stopped portion 45 made of a flat-plate-like upright portion is integrally formed on one end portion of the lock lever 43. A wire attached portion 46 formed of an L-shaped upright portion is integrally formed on the other end portion of the lock lever 43. Since the stopped portion 45 is inserted in an incision 47 formed in the attaching base 41, the forward and backward pivot positions of the lock lever 43 are regulated by the attaching base 41. The wire attached portion 46 fixes the distal end portion of an attaching rod 48, the proximal end portion of which extends from the lock lever 43. The free end portion of the tractive wire 32*a* is fixed to the attaching rod 48.

A spring retainer 49 which can have a substantially cup-like shape is formed on the attaching base 41 by monolithic molding or with an adhesive. The tractive wire 32*a* is inserted in a wire inserting hole 50 of the spring retainer 49. The tractive wire 32*a* extends through a flexible tube 52 made of an appropriate elastic material such as synthetic rubber. One end portion of the tube 52 is held in position by the arcuated piece 29*a* and subsidiary guide plate 31*a* of the button holding member 23, and abuts against a front end face 63 of the member main body 25. The other end portion of the tube 52 abuts against the spring retainer 49. One end portion of a tube 52 identical to the above tube 52 and used by the left subsidiary cap portion locking mechanism 21 is also held in position by the arcuated piece 29*b* and subsidiary guide plate 31*b* of the button holding member 23, and abuts against the front end face 63 of the member main body 25.

A compression coil spring 51 through which the tractive wire 32*a* extends is interposed between the spring retainer 49 and the wire attached portion 46 of the lock lever 43. For this reason, the lock lever 43 is biased by the coil spring 51 to pivot counterclockwise in FIG. 4 about the attaching screw 44 as the center. Since the lock lever 43 is biased to pivot counterclockwise in FIG. 4, the release button 22 is tractively biased by the tractive wire 32*a* to move backward in the direction indicated by the arrow B in FIGS. 4 and 7.

The release button 22 can move forward in the direction indicated by the arrow A in FIGS. 4 and 7 against the tractive biasing force of the tractive wire 32*a*. The forward moving direction A of the release button 22 forms an acute angle θ with respect to a downward moving direction (i.e., a backward pivot direction about the attaching screws 7 as the fulcrum) C of the subsidiary cap portion 6, as shown in FIG. 4. In the embodiment shown in FIG. 4, the acute angle θ is about 25°. However, from the viewpoint of practicability, this angle is preferably 0° to 60°, and more preferably 0° to 45°. The forward moving direction A of the release button 22 is inward (i.e., backward in FIG. 4) of the downward moving direction C of the subsidiary cap portion 6. However, this direction A need not be inward but can be outward. In order to operate the release button 22 forward and move the subsidiary cap portion 6 upward very smoothly, the forward moving direction A of the release button 22 is preferably inward of the downward moving direction C of the subsidiary cap portion 6. In this case, the acute angle θ is particularly preferably 5° to 45°.

A pair of right and left lock pins 54 serving as a stationary locking means or member project near the lower end of the outer surface of the outer shell 11 of the main cap portion 5. The lock levers 43 of the right and left subsidiary cap portion locking mechanisms 21 selectively engage with the lock pins 54 depending on their pivot positions. Each lock lever 43 is formed with an abutting portion 43*a* against which the corresponding lock pin 54 abuts. A locking recess 62 to engage with the lock pin 54 is formed adjacent to the abutting portion 43*a*.

The respective portions (i.e., the attaching bases 41, coil springs 51, lock levers 43, attaching rods 48, attaching screws 42 and 44, and the like) of the locking mechanisms 21, the release button 22, the button holding mechanism 20 (i.e., the button holding member 23, attaching bosses 33*a* and 33*b*, and the like), the wire attaching member 39, the washer 74, the attaching screws 73*a*, 73*b*, and 75, the tubes 52, the tractive wires 32*a* and 32*b*, and the like are arranged along the inner surface of the outer shell 14 for the subsidiary cap portion. Hence, recesses and ridge grooves for accommodating these portions are formed in the surface of the impact absorbing liner for the subsidiary cap portion that opposes the outer shell 14.

As shown in FIGS. 1 to 3, a ventilation aperture forming member 55 for the forehead is attached to the outer surface of the forehead portion of the main cap portion 5. A stopper 56 for regulating the backward position of the shield plate 4 is provided to the right portion of the outer surface of the subsidiary cap portion 6. Various types of ventilation apertures 57, 58, and 59 are formed in the chin cover 6*a* of the subsidiary cap portion 6. As shown in FIGS. 4 to 6, an air guide plate 60 is attached to the inner surface of the chin cover 6*a* with attaching screws 61 so as to oppose the ventilation apertures 57. Therefore, air flowing into the head protecting body 2 through the ventilation apertures 57 is guided by the front surface of the air guide plate 60 to move upward in the head protecting body 2 along the inner surface of the shield plate 4.

How to use the full-face-type helmet serving also as the jet-type helmet having the above arrangement will be described.

Assume that the wearer wishes to use the helmet 1 as a full-face-type helmet. If the subsidiary cap portion 6 is at the upper position, as shown in FIG. 3, the wearer pivots it downward about the attaching screws 7 as the center, thereby bringing it to the lower position shown in FIGS. 1 and 2.

In this case, the abutting portions 43*a* of the lock levers 43 provided to the subsidiary cap portion 6 as shown in FIG. 6 abut against the lock pins 54. The lock levers 43 are accordingly pressed by the lock pins 54, and pivot slightly forward clockwise in FIG. 6 about the attaching screws 44 as the fulcrum against the biasing force of the coil springs 51. The lock pins 54 thus ride over the abutting portions 43*a* of the lock levers 43, as shown in FIG. 4, to engage with the corresponding locking recesses 62. The subsidiary cap portion 6 is securely locked by the main cap portion 5 with the pair of right and left subsidiary cap portion locking mechanisms 21, so that the head protecting body 2 serves as the full-face-type.

Assume that the wearer wishes to use the helmet 1 shown in FIGS. 1 and 2, currently serving as the full-face-type helmet, as a jet-type helmet shown in FIG. 3. In the state shown in FIG. 4, the wearer inserts his finger (e.g., index finger and/or middle finger) in the notched portion 28 of the release button 22 through the aperture 34 located at substantially the central portion of the outer surface of the chin cover 6*a* of the subsidiary cap portion 6. The wearer presses the press surface 28*a* of the release button 22 with this finger downward in the forward direction, indicated by the arrow A in FIG. 4, against the biasing force of the coil springs 51. In this case, since the press surface 28*a* substantially perpendicularly intersects the forward direction A of the release button 22, the direction of the force applied by the finger onto the release button 22 substantially coincides with this forward direction A.

Since the release button 22 moves forward in the direction indicated by the arrow A against the biasing force of the coil springs 51, the tractive wire 32*a* is pulled by the release button 22 to slide along the arcuated piece 29*a* of the button holding member 23. Therefore, the lock levers 43 in the state shown in FIG. 4 pivot forward clockwise about the attaching screws 44 as the fulcrum to be set in the state shown in FIG. 5. This unlocks the subsidiary cap portion 6 locked on the main cap portion 5 by the subsidiary cap portion locking mechanisms 21. Accordingly, if the wearer simultaneously places his finger (e.g., the thumb) on substantially the central portion of the lower end of the subsidiary cap portion 6 (e.g., grabs the subsidiary cap portion 6 from the upper and lower sides with his index finger and/or middle finger inserted in the notched portion 28 and his thumb placed on substantially the central portion of the lower end of the subsidiary cap portion 6), and raises the subsidiary cap portion 6, the subsidiary cap portion 6 pivots upward about the attaching screws 7 as the fulcrum. The subsidiary cap portion 6 is set in the state shown in FIG. 3 through the state shown in FIG. 6. Thus, the head protecting body 2 serves as the jet-type.

In the first embodiment, the tractive wires 32*a* and 32*b* are inserted in the tubes 52. The tractive wires 32*a* and 32*b* can be easily set not to come into substantial contact with any foreign matter other than the tubes 52. As a result, the tractive wires 32*a* and 32*b* can always move comparatively smoothly. These tubes 52 can be omitted if necessary. If the tubes 52 are omitted, the tractive wires 32*a* and 32*b* are preferably selected to have such a length that they extend substantially linearly between the arcuated pieces 29*a* and 29*b* of the guide plate 30 of the button holding member 23 and the spring retainers 49 of the attaching bases 41.

Second Embodiment

The second embodiment in which the present invention is applied to a full-face-type helmet serving also as a jet-type helmet will be described with reference to FIGS. 10 to 22.

The helmet of the second embodiment shown in FIGS. 10 to 22 has substantially the same arrangement, function, and effect as those of the helmet according to the first embodiment described above shown in FIGS. 1 to 9, except for the differences and respects concerning them described in the following items (1) to (7). Accordingly, in the following description, only the differences and respects concerning them described in these items (1) to (7) will be described. Portions that are common between the helmet according to the second embodiment shown in FIGS. 10 and 22 and the helmet according to the first embodiment described above shown in FIGS. 1 to 9 are denoted by the same reference numerals, and a description other than the differences and respects concerning them will be omitted.

(1) A pair of right and left support plates 81 for supporting a subsidiary cap portion 6 onto a main cap portion 5 are provided to the main cap portion 5.

(2) Cover members corresponding to the cover members 17 for covering attaching screws 7 used to attach the subsidiary cap portion 6 to the main cap portion 5 are omitted.

(3) A finger putting plate 83 serving as a finger putting portion is provided to a button holding member 23 of a button holding mechanism 20.

(4) A subsidiary attaching base 82 is provided to an attaching base 41 of each subsidiary cap portion locking mechanism 21.

(5) A pair of left and right flexible tubes, corresponding to the tubes 52 through which a pair of left and right tractive wires 32*a* and 32*b* are inserted, are omitted.

(6) A wire attaching member 39 of the button holding mechanism 20 is arranged upside down.

(7) The arrangement of ventilation apertures 59 formed in a chin cover 6*a* of the subsidiary cap portion 6 is altered.

Items (1) and (2)

Figure 11:
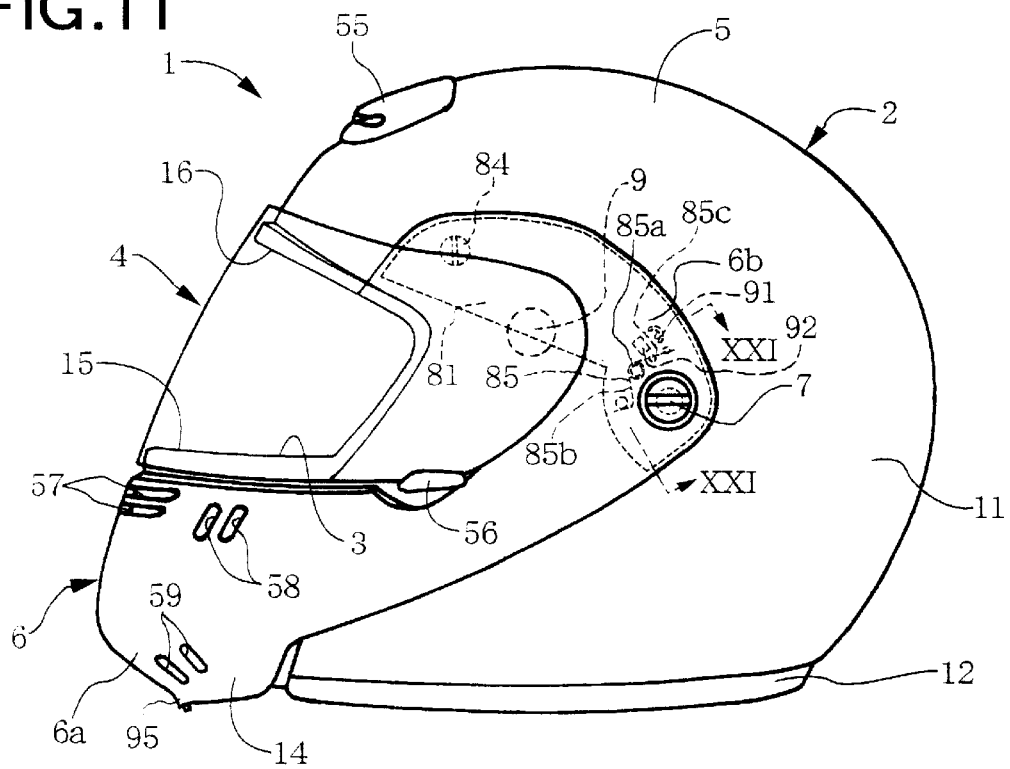
FIG. 11 is a right side view of the entire portion of the helmet shown in FIG. 10 in an ordinary worn state.
Figure 12:
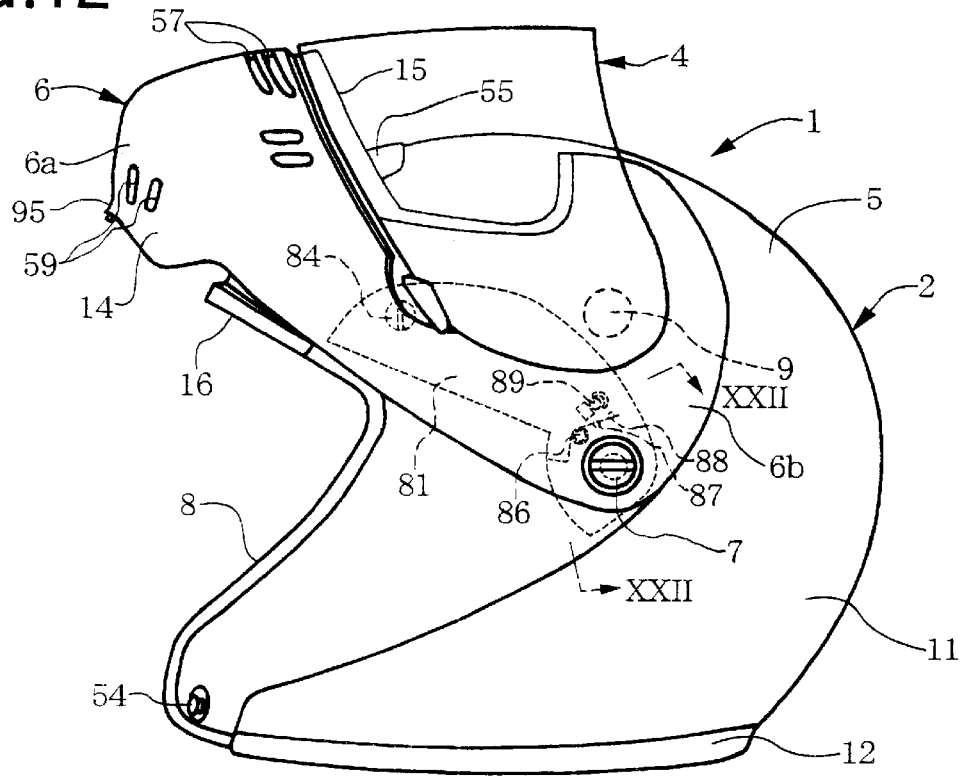
FIG. 12 is a right side view of the entire portion of the helmet shown in FIG. 10 with the subsidiary cap portion raised.

Each of the pair of right and left support plates 81 is an elongated platelike member extending in substantially the back-and-forth direction, as shown in FIGS. 11 and 12, and can be made of a material similar to that described above concerning the button holding member 23. The support plates 81 are fixed to an outer shell 11 for a main cap portion with attaching screws 84 at their portions near the front end portions. The portions of the support plates 81 near the rear end portions are also fixed, together with ears 6*b* of the subsidiary cap portion 6, to the outer shell 11 for the main cap portion with attaching screws (i.e., axial support means) 7. The cover members 17 provided in the first embodiment for the attaching screws 7 are omitted in the second embodiment.

Figure 21:
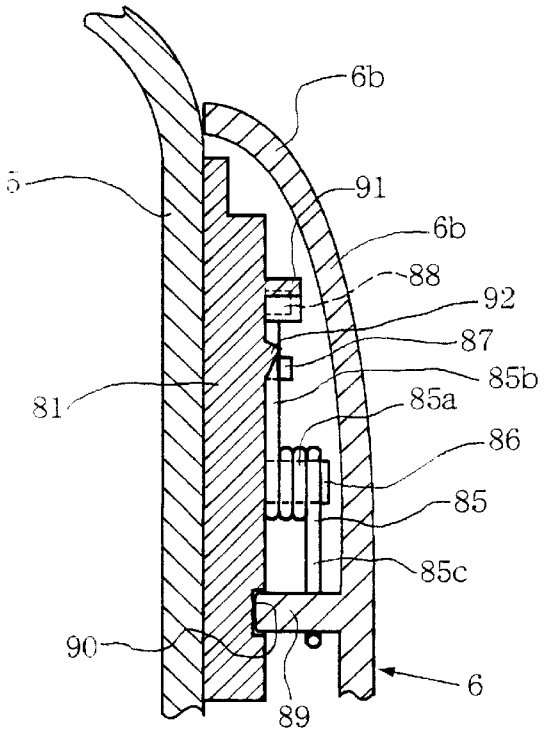
FIG. 21 is a sectional view taken along a line XXI—XXI in FIG. 11.
Figure 22:
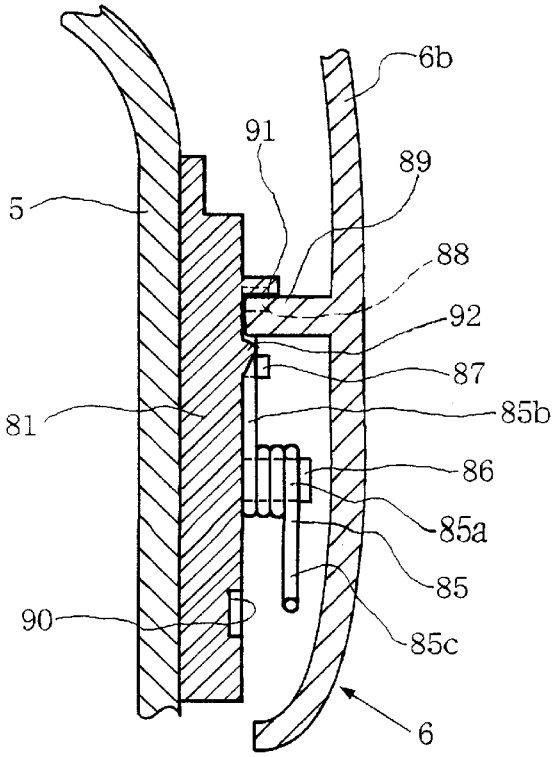
FIG. 22 is a sectional view taken along a line XXII—XXII in FIG. 12.

As shown in FIGS. 21 and 22, a projection 86 to fit in a coil portion 85*a* provided at the central portion of a spring 85 serving as a biasing means is formed on each support plate 81 by monolithic molding or the like. The spring 85 serves as a torsion coil spring, and further has first and second wire portions 85*b* and 85*c* extending from the coil portion 85*a* in substantially the opposite directions. The support plate 81 is formed with a pair of spring catching projections 87 and 88 by monolithic molding or the like to engage with the first coil portion 85*b*. The first wire portion 85*b* is inserted between the pair of projections 87 and 88.

As shown in FIGS. 21 and 22, a pair of right and left projections 89 serving as positioning means project from the inner surface of an outer shell 14 at each of the pair of right and left ears 6*b* of the subsidiary cap portion 6. The second wire portion 85*c* of the spring 85 is bent almost arcuatedly. When the subsidiary cap portion 6 is at the lower position, as shown in FIGS. 11 and 21, the positioning projection 89 serving also as the spring hook means presses against the arcuated second wire portion 85*c*.

The support plates 81 are formed with a pair of right and left recesses 90 serving as positioning means. When the subsidiary cap portion 6 is at the lower position, as shown in FIG. 11, the positioning projections 89 lightly engage or fit with the recesses 90, as shown in FIG. 21, to prohibit the subsidiary cap portion 6 from moving with a comparatively small action force. When the projections 89 engage or fit with the recesses 90, the upward biasing force for the subsidiary cap portion 6 generated by the springs 85 can be entirely or partially reduced by this engagement or fitting. The subsidiary cap portion 6 located at the lower position is not only locked at the lower position by the pair of right and left subsidiary cap portion locking mechanisms 21, but is lightly held in position at the lower position by the recess-projection engagement of the positioning means 89 and 90, 50 that its forward movement is prohibited by a comparatively small action force. The springs 85 bias the subsidiary cap portion 6 upward (i.e., in the forward direction) through the positioning projections 89, so that the subsidiary cap portion 6 is raised smoothly when the recess-projection engagement is canceled. Furthermore, since the springs 85 bias the subsidiary cap portion 6 clockwise in FIGS. 11 and 13 with respect to the main cap portion 5 about the attaching screws (i.e., axial support means) 7 as the fulcrum, they prevent lock pins 54 from removing accidentally from locking recesses 62 of lock levers 43 upon vibration or the like of the helmet 1.

Each support plate 81 is formed with a substantially semicylindrical stopper projection 91 by monolithic molding or the like. When the subsidiary cap portion 6 is at the upper position, as shown in FIG. 12, the positioning projection 89 engages with the stopper projection 91, as shown in FIG. 22. The support plate 81 is also formed with a stopper projection 92, having an inclined surface, adjacent to the stopper projection 91 by monolithic molding or the like. While the subsidiary cap portion 6 moves from the lower position to immediately before the upper position, the positioning projection 89 gradually rides over the inclined surface of the stopper projection 92. Accordingly, while the subsidiary cap portion 6 moves from the lower position to immediately before the upper position, the positioning projection 89 rides over the inclined surface of the stopper projection 92 and thereafter passes it. As a result, as shown in FIG. 22, the positioning projection 89 (and also the subsidiary cap portion 6) is completely prohibited by the stopper projection 91 from moving further forward and by the stopper projection 92 from moving backward, with a comparatively small action force.

Item (3)

The finger putting plate 83 having a substantially vertical finger putting surface 83*a* is formed on the rear end face of a member main body 25 of the button holding member 23 of the button holding mechanism 20 by monolithic molding or the like. The finger putting surface 83*a* has projecting ridges 93*a*, 93*b*, and 94 at its left and right side end portions and lower end portion, respectively. The projecting ridges 93*a*, 93*b*, and 94 form a substantially U-letter shape as a whole. Accordingly, when raising the subsidiary cap portion 6, if the wearer places his finger (e.g., thumb) on the finger putting surface 83*a* of the finger putting plate 83, in place of placing his finger at substantially the central portion of the lower end of the subsidiary cap portion 6 as in the first embodiment, and thereafter raises the subsidiary cap portion 6 upward, this raising operation can be performed smoothly.

The outer shell 14 is formed with an expansion 95 at substantially the central portion of the lower end of the chin cover 6*a* of the subsidiary cap portion 6 to slightly expand forward to conform to the shape of the finger putting plate 83.

Item (4)

Figure 13:
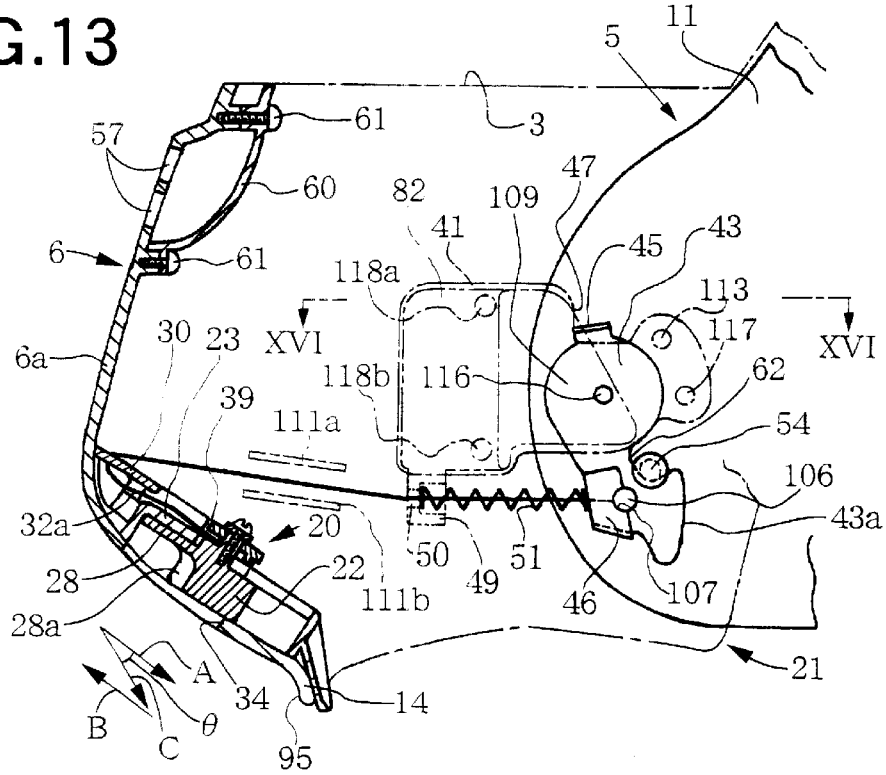
FIG. 13 is a longitudinal sectional partial view, taken along the center, of the helmet shown in FIG. 11, which explains the subsidiary cap portion locking mechanism and from which the backing member and rim member for the subsidiary cap portion are omitted.
Figure 14:
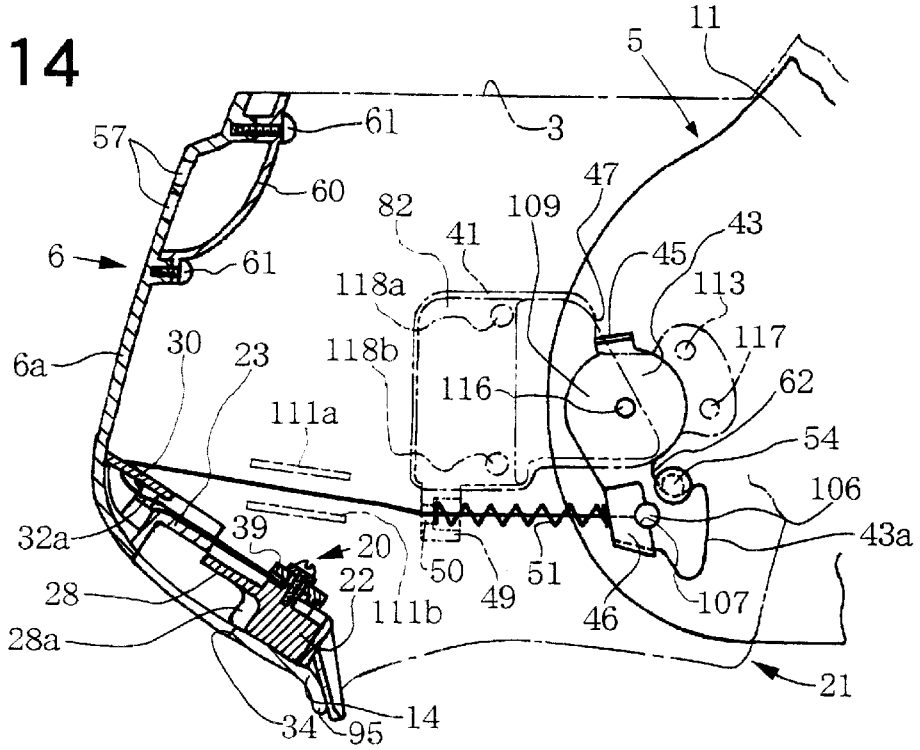
FIG. 14 is a view similar to FIG. 13, showing a state wherein the release button is depressed.
Figure 15:
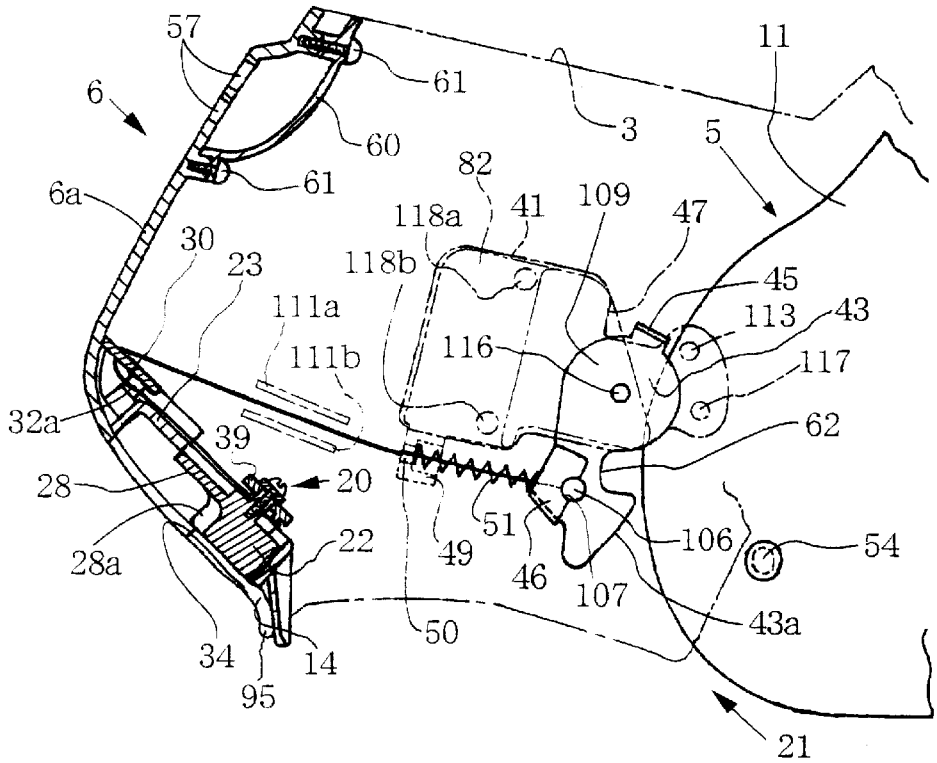
FIG. 15 is a view similar to FIG. 13, showing a state wherein the subsidiary cap portion is slightly raised from the state shown in FIG. 14.
Figure 17:
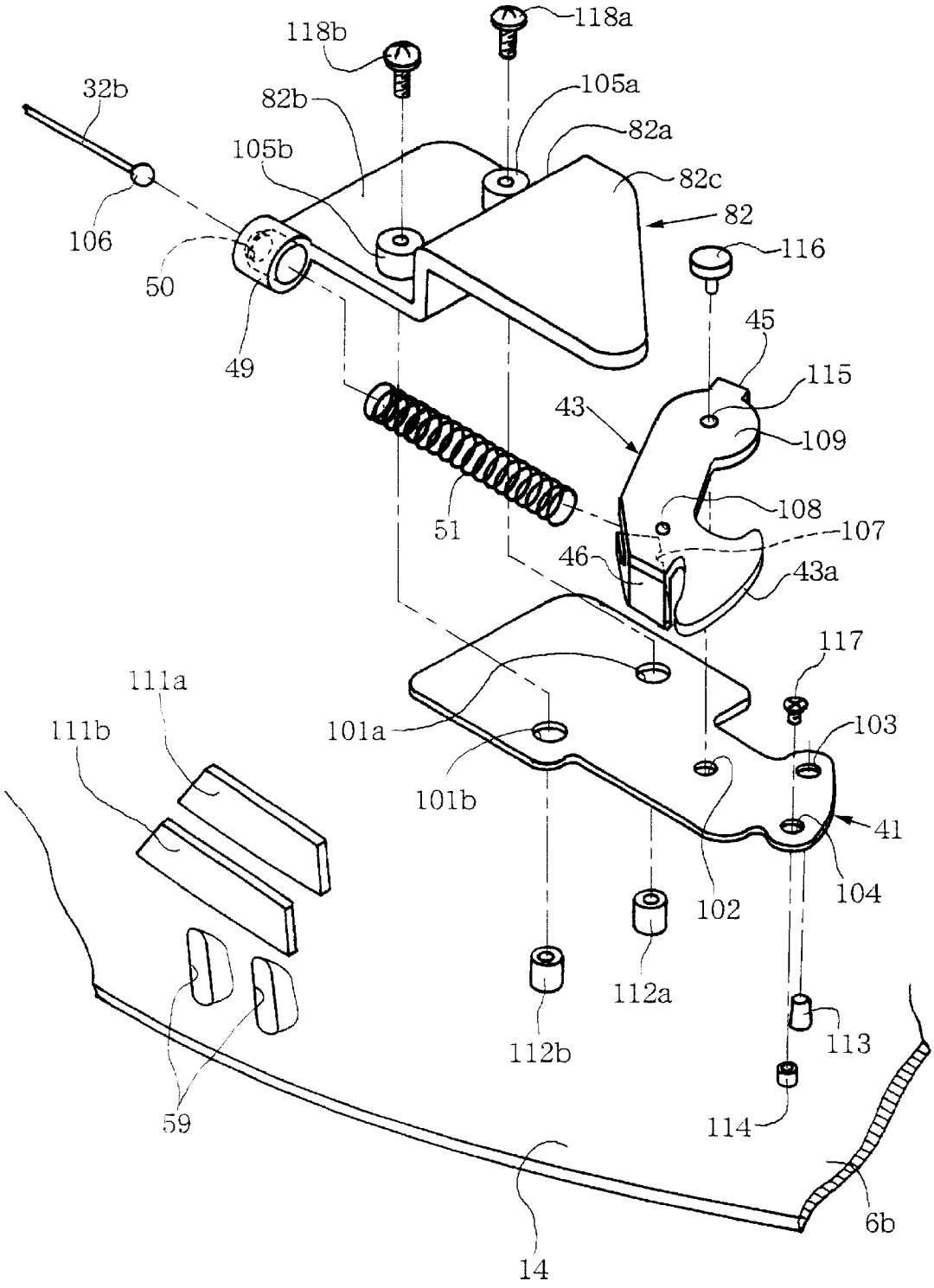
FIG. 17 is a perspective exploded view of the main part of the right subsidiary cap portion locking mechanism shown in FIG. 13.

In the second embodiment, the attaching base 41 corresponding to the attaching base 41 of the first embodiment is constituted by the main attaching base 41 and the subsidiary attaching base 82, as shown in FIGS. 13 and 17. In this case, the subsidiary attaching base 82 may be made of the same material as that described above concerning the attaching base 41. Note that the main attaching base 41 is preferably made of a metal and the subsidiary attaching base 82 is preferably made of a synthetic resin.

As shown in FIG. 17, the main attaching base 41 can have a flat platelike shape. The main attaching base 41 is formed with a pair of boss inserting holes 101*a* and bib, a rivet inserting hole 102, a boss inserting hole 103, and a screw inserting hole 104. In the first embodiment, the spring retainer 49 is formed on the attaching base 41. In the second embodiment, a spring retainer 49 is formed on the subsidiary attaching base 82 by monolithic molding or the like. The subsidiary attaching base 82 has a step 82*a* at substantially its central portion, and a front plate 82*b* and a rear plate 82*c* on the two sides of the step 82*a*. The rear plate 82*c* is formed with a pair of screw inserting bosses 105*a* and 105*b* and the spring retainer 49 by monolithic molding or the like.

Spherical bodies 106 made of a metal or the like are fixed to the free ends of the pair of right and left tractive wires 32*a* and 32*b*, as shown in FIGS. 13 and 17. A substantially semicircular engaging notch 107 is formed on the free end of a wire attached portion 46 of each lock lever 43. A substantially circular engaging aperture 108 is formed in a lever main body 109 of the lock lever 43, on a side of the engaging notch 107 opposite to the outer shell 14.Portions near the free ends of the tractive wires 32*a* and 32*b* are inserted between the lever main bodies 109 of the lock levers 43 and the wire attached portions 46 from above, and the spherical bodies 106 are fitted in the engaging notches 107 and engaging apertures 108, thereby fixing the free ends of the tractive wires 32*a* and 32*b* to the lock levers 43.

On the inner surface of the outer shell 14, a pair of upper and lower projecting ridges 111*a* and 111*b* extending substantially horizontally are formed on each of the left and right sides of the chin cover 6*a* of the subsidiary cap portion 6, as shown in FIGS. 13 and 17, by monolithic molding or the like. On the inner surface of the outer shell 14, a pair of upper and lower screwing bosses 112*a* and 112*b*, a positioning boss 113, and a screwing boss 114 are formed on each of the left and right sides of the chin cover 6*a* of the subsidiary cap portion 6 by monolithic molding or the like, to be adjacent to the projecting ridges 111*a* and 111*b*. The substantially intermediate portion of each of the tractive wires 32*a* and 32*b* is interposed between the corresponding pair of projecting ridges 111*a* and 111*b* so that it is positioned to a certain degree. A rivet 116 inserted in a rivet engaging hole 115, formed in the lever main body 109 of the lock lever 43, and the rivet engaging hole 102 in the main attaching base 41 pivotally fixes the lock lever 43 to the attaching base 41. The positioning boss 113 is fitted in the boss inserting hole 103 of the attaching base 41, and the front surface of the attaching base 41 is abutted against the distal end face of the screwing boss 114. After that, a screw 117 is inserted in the screw inserting hole 104 of the attaching base 41 and screwed into the screwing boss 114, thereby fixing the attaching base 41 to the inner surface of the outer shell 14.

As shown in FIGS. 13 and 17, the pair of screwing bosses 112*a* and 112*b* are inserted in the boss inserting holes 101*a* and 101*b* of the attaching base 41. The distal end faces of the bosses 112*a* and 112*b* abut against a surface, on the outer shell 14 side, of the front plate 82*b* of the subsidiary attaching base 82. A pair of upper and lower screws 118*a* and 118*b* are inserted in the screw inserting bosses 105*a* and 105*b*, and screwed into the screwing bosses 112*a* and 112*b*, thereby fixing the subsidiary attaching base 82 and main attaching base 41 to the inner surface of the outer shell 14.

Figure 16:
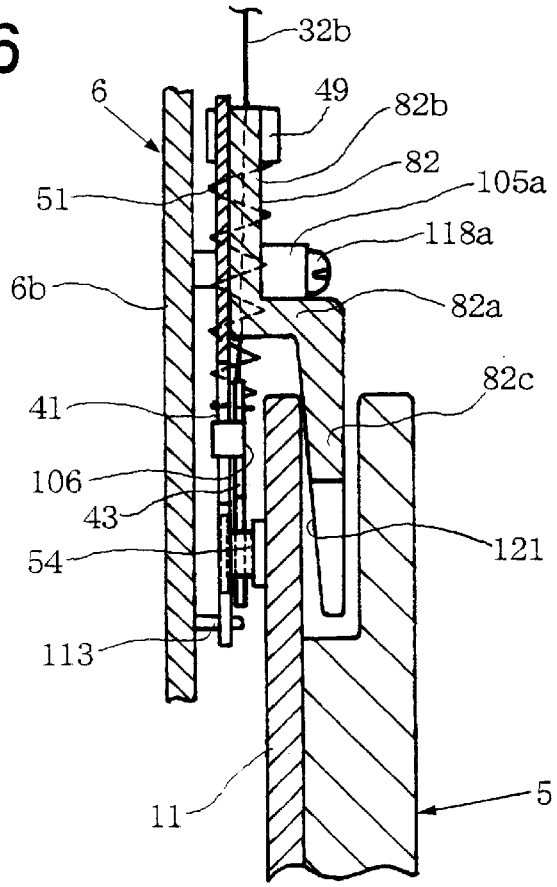
FIG. 16 is a sectional view taken along a line XVI—XVI in FIG. 13.

According to the above arrangement, as shown in FIG. 16, a gap 121 is defined by the main attaching base 41, the lock lever 43, and the rear plate 82*c* of the subsidiary attaching base 82. Accordingly, the subsidiary attaching base 82 serves as a gap defining member as well. When the subsidiary cap portion 6 is at the lower position shown in FIGS. 13 and 14 and at the intermediate position shown in FIG. 15 which is slightly above the lower position, portions of the outer shell 11 of the main cap portion 5 near its lower end are inserted in the corresponding gaps 121. Therefore, portions of the outer shell 11 near its lower end (also the lock pins 54) and the lock levers 43 of the subsidiary cap portion 6 are positioned relative to each other to a certain degree in the direction of thickness of the outer shell 11. This can prevent the lock pins 54 from accidentally, relatively removing from the locking recesses 62 of the lock levers 43, or from abutting portions 43*a* of the lock levers 43, to a certain degree. A cover member (not shown) for covering the outer surface and, if necessary, the inner surface as well, of a portion of the outer shell 11 near its lower end may be provided, and the lock pins 54 may be fixed to the cover member. This cover member can be made of the same material as that described above concerning the button holding member 23.

As shown in FIG. 16, on the inner surface of the outer shell 14, the pair of right and left subsidiary attaching bases 82 are formed on the right and left sides of the chin cover 6*a* of the subsidiary cap portion 6. Accordingly, the gap 121 is formed on each of the right and left sides to form a pair. A pair of right and left portions of the outer shell 11, near the lower end, of the main cap portion 5 are inserted in the pair of right and left gaps 121, respectively. This insertion amount is the maximum when the subsidiary cap portion 6 is at the lower position shown in FIGS. 13 and 14, and decreases gradually as the subsidiary cap portion 6 moves forward from the lower position shown in FIGS. 13 and 14 to the intermediate position shown in FIG. 15 which is slightly above the lower position. When the subsidiary cap portion 6 further moves upward from the intermediate position shown in FIG. 15, the pair of right and left portions of the outer shell 11 near its lower end completely disengage from the pair of right and left gaps 121. When the subsidiary cap portion 6 moves downward, an operation precisely opposite to that described above is performed.

Item (5)

In the first embodiment, the pair of left and right tubes 52 are provided to extend the pair of left and right tractive wires 32*a* and 32*b* therethrough. In the second embodiment, such tubes 52 are omitted. Therefore, the tractive wires 32*a* and 32*b* extend substantially linearly between arcuated pieces 29*a* and 29*b* of a guide 30 of the button holding member 23 and the spring retainers 49 of the subsidiary attaching bases 41.

Item (6)

Figure 18:
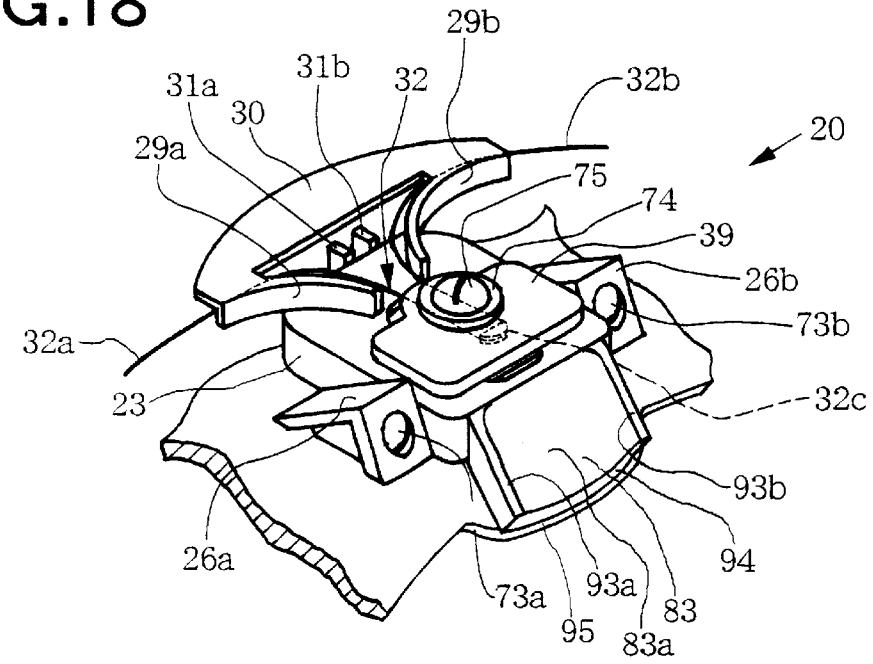
FIG. 18 is a perspective view of the release button and a holding mechanism for it shown in FIG. 13.
Figure 19:
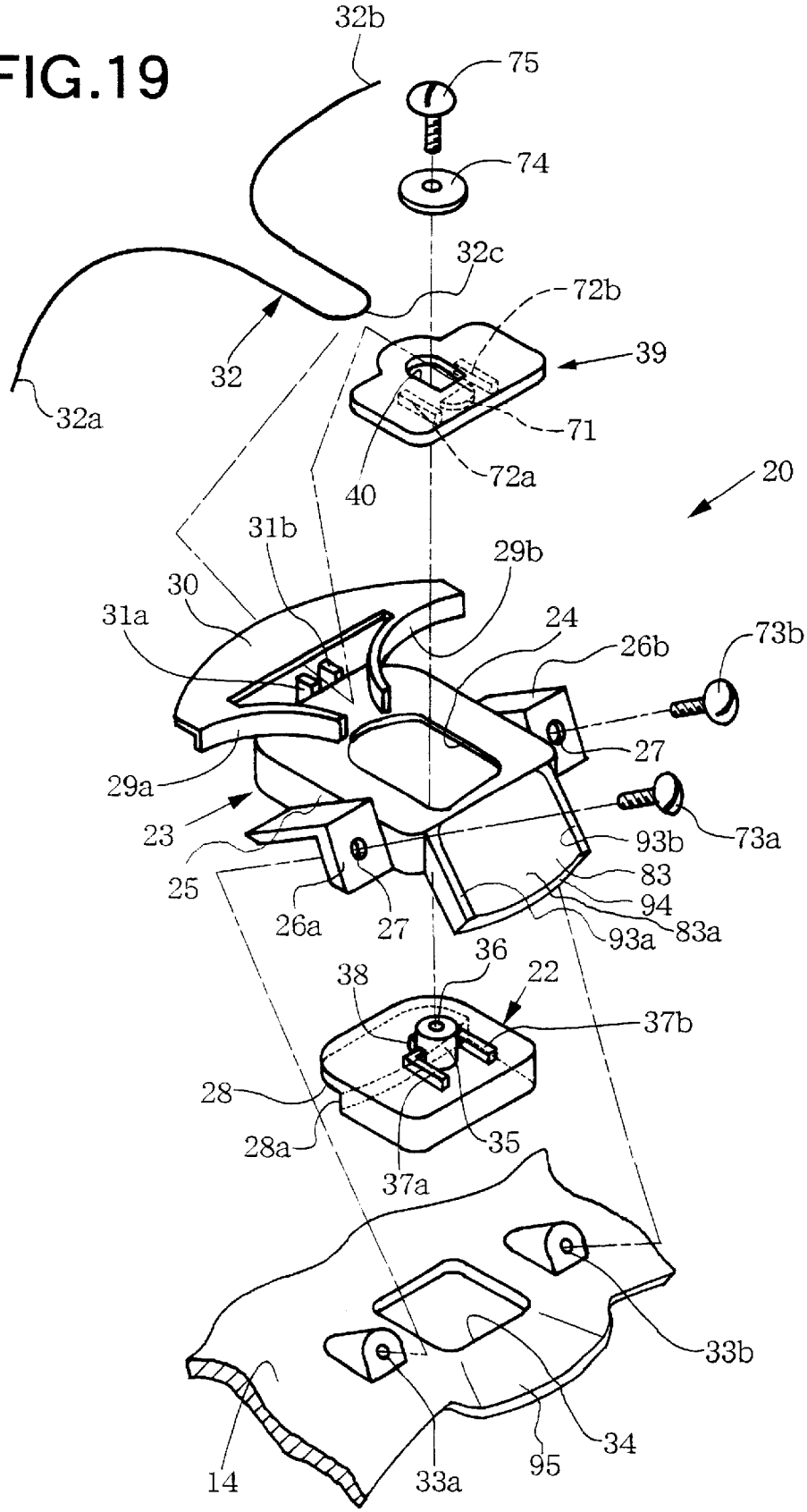
FIG. 19 is an exploded perspective view of the release button and the holding mechanism for it shown in FIG. 18.

In the second embodiment, the wire attaching member 39 of the button holding mechanism 20 is arranged upside down from the state of the first embodiment, as shown in FIGS. 18 and 19. Accordingly, a wire engaging portion 71 and a pair of left and right projecting ridges 72*a* and 72*b* are formed on the surface of the wire attaching member 39 on the outer shell 14 side.

Figure 20:
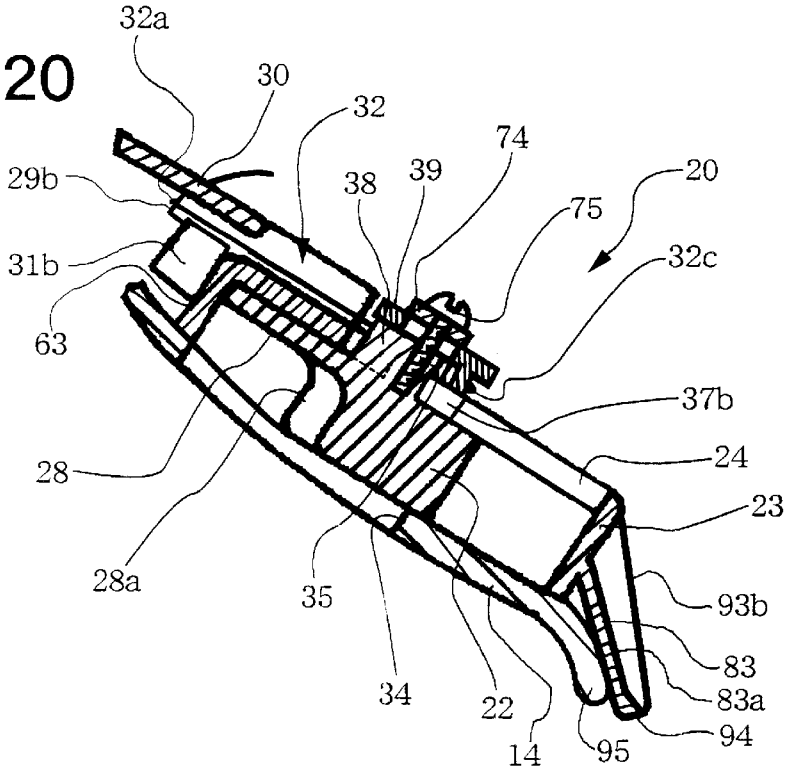
FIG. 20 is a longitudinal sectional view, taken along the center, of the release button and the holding mechanism for it shown in FIG. 18.

In the post-assembly state shown in FIGS. 18 and 20, a pair of left and right arms 37*a* and 37*b* of a release button (i.e., unlocking member) 22 are fitted between the pair of left and right projecting ridges 72*a* and 72*b* of the wire attaching member 39. In other words, a projection formed by the pair of left and right arms 37*a* and 37*b* (the intermediate portion of this projection, i.e., the portion between the pair of arms 37*a* and 37*b*, forms a notch) is fitted in a recess formed between the pair of left and right projecting ridges 72*a* and 72*b* through recess-projection fitting, to be linearly, reciprocally slidable.

The wire engaging portion 71 of the wire attaching member 39 is inserted between the pair of left and right arms 37*a* and 37*b*. A U-shaped intermediate portion 32*c* of the tractive wire 32 is hooked on the wire engaging portion 71, and abuts against the right and left sides of a columnar portion 35 of the release button 22. Accordingly, the intermediate portion 32*c* is securely sandwiched from the two sides by the proximal end portions of the pair of left and right arms 37*a* and 37*b* of the release button 22 and a surface of the wire attaching member 39 on the outer shell 14 side.

In the first embodiment, the pair of arms 37*a* and 37*b* of the release button 22 linearly, reciprocally slide along the rim of the elongated hole 24 of the button holding member 23. In contrast to this, in the second embodiment, the pair of projecting ridges 72*a* and 72*b* of the wire attaching member 39 linearly, reciprocally slide along the rim of an elongated hole 24 corresponding to their counterpart of the first embodiment.

Item (7)

In the first embodiment, the chin cover 6*a* of the subsidiary cap portion 6 is formed with the pair of right and left comparatively large ventilation apertures 59. In contrast to this, in the second embodiment, the right and left ventilation aperture pairs 59, each consisting of comparatively small two, front and rear ventilation apertures, are formed.

Having described two specific preferred embodiments of this invention with reference to the accompanying drawings, it is to be understood that the invention is not limited to that precise embodiments, and that various changes and modifications may be effected therein by one skilled in the art without departing from the scope or spirit of the invention as defined in the appended claims.

For example, in the first and second embodiments, the direction perpendicularly intersecting the press surface 28*a* of the release button 22 substantially coincides with the forward moving direction A of the release button 22. However, if these two directions more or less do not coincide with each other, no problem arises. In this case as well, an acute angle θ' formed by the direction perpendicularly intersecting the press surface 28*a* of the release button 22 with respect to the downward moving direction C of the subsidiary cap portion may have the same angular range as that described concerning the acute angle θ.

What is claimed is:

1. A helmet including a cap-shaped head protecting body to be worn by a helmet wearer on his/her head, said head protecting body having a main cap portion and a subsidiary cap portion attached to said main cap portion to be substantially vertically movable so as to selectively cover a chin of the helmet wearer, said head protecting body being provided with first and second locking mechanisms for respectively locking left and right sides of said subsidiary cap portion with respect to said main cap portion when said subsidiary cap portion is at a lower position to cover the chin, and said head protecting body being also provided with a common unlocking member which is operated forward to commonly unlock said subsidiary cap portion locked by said first and second locking mechanisms, wherein:

a common tractive flexible wire is provided, said common tractive flexible wire commonly transmitting forward movement of said unlocking member to first and second movable locking members of said first and second locking mechanisms, one end portion of said wire is connected to said first movable locking member and the other end portion of said wire is connected to said second movable locking member, said unlocking member is provided with a wire engaging portion, an intermediate portion of said wire is engaged by said wire engaging portion, said wire engaging portion is formed substantially semicircularly on a wire attaching member attached to said unlocking member, and said intermediate portion of said wire is hooked and engaged by a substantially arcuated portion of said substantially semicircular wire engaging portion to form substantially a U-letter shape.

2. A helmet according to claim 1, wherein:

said wire attaching member is attached to said unlocking member so that when said wire attaching member is slid with respect to said unlocking member, a position where said wire attaching member is attached on said unlocking member is adjusted, thereby removing a slack of said wire.

3. A helmet according to claim 2, wherein:

a projection formed in one of said unlocking member and said wire attaching member, and a recess formed in the other one of said unlocking member and said wire attaching member are provided, and said projection is fitted in said recess to be linearly reciprocal relative to said recess, so that said wire attaching member is slidable with respect to said unlocking member.

4. A helmet according to claim 1, wherein:

an unlocking member holding mechanism is provided, said unlocking member holding mechanism accommodating and reciprocally holding said unlocking member, and said unlocking member holding mechanism is constituted by an outer shell of said subsidiary cap portion and a holding member attached to an inner surface of said outer shell.

5. A helmet according to claim 4, wherein:

said holding member has a finger putting surface against which a finger is to be abutted when moving said unlocking member forward.

6. A helmet according to claim 4, wherein:

said holding member has a pair of left and right arcuated pieces extending widely to the left and right, respectively, and left and right side portions of said wire that are directly continuous to said substantially U-shaped intermediate portion are wound on said pair of left and right arcuated pieces.

7. A helmet according to claim 1, wherein:

a pair of left and right wire portions of said wire, that are respectively continuous to said intermediate portion are inserted in a pair of left and right flexible tubes.

8. A helmet according to claim 1, wherein:

a set of plurality of projecting ridges are provided to each of left and right sides of an inner surface of said outer shell of said subsidiary cap portion, said projecting ridges extending substantially parallel to each other to interpose, therebetween, a pair of left and right wire portions of said wire that are respectively continuous to said intermediate portion, for the purpose of positioning.

9. A helmet according to claim 1, wherein:

said subsidiary cap portion is formed with first and second gap defining members on left and right sides thereof, and when said subsidiary cap portion is at least at the lower position, left and right portions of said head protecting body near a lower end thereof are respectively inserted in first and second gaps defined between said left and right sides of said subsidiary cap portion and said first and second gap defining members.

10. A helmet according to claim 1, wherein:

each one of said first and second locking mechanisms has first and second attaching bases respectively attached with said first and second movable locking members, said first and second attaching bases are respectively constituted by a metal main attaching base pivotally, axially supporting a corresponding one of said first and second movable locking members, and a synthetic-resin subsidiary attaching base attached to said main attaching base, and said subsidiary attaching base is integrally molded with a retainer portion for holding one end of biasing means which biases said movable locking member in a backward direction.

11. A helmet according to claim 10, wherein:

said subsidiary attaching base also serves as said gap defining member.

12. A helmet according to claim 1, wherein:

spherical bodies are respectively fixed to one and the other end portions of said wire, substantially L-shaped upright portions are formed on member main bodies of said first and second locking members of said first and second locking mechanisms, respectively, said member main bodies are respectively formed with substantially circular holes, and substantially semicircular notches are formed in free end portions of said upright portions, and said spherical bodies are fitted in said holes and said notches, so that said one and the other end portions of said wire are connected to said first nad second movable locking members through said spherical bodies.

13. A helmet according to claim 1, wherein:

said helmet is provided with second biasing means for biasing said subsidiary cap portion at the lower position upward with respect to said main cap portion in order to prevent said subsidiary cap portion locked by said first and second locking mechanisms from being unnecessarily unlocked.

14. A helmet according to claim 13, wherein:

said second biasing means is a torsion coil spring.

15. A helmet according to claim 14, wherein:

said torsion coil spring is attached to a subsidiary cap portion support plate, said subsidiary cap portion support plate is attached to said main cap portion, and said subsidiary cap portion is attached to said subsidiary cap portion support plate through said axial support means to be substantially vertically pivotal with respect to said main cap portion.

16. A helmet according to claim 1, wherein:

a positioning mechanism is provided separately of said unlocking mechanisms to prohibit, with a comparatively small action force, said subsidiary cap portion from moving upward with respect to said main cap portion when said subsidiary cap portion is at the lower position, said positioning mechanism is constituted by first positioning means provided to said main cap portion, and second positioning means provided to said subsidiary cap portion to fit with said first positioning means through recess-projection fitting, second biasing means is further provided to bias said subsidiary cap portion upward with respect to said main cap portion when said subsidiary cap portion is at the lower position, and said biasing means has a biasing force with such a strength that cannot disengage said positioning mechanism fitted by recess-projection fitting.

17. A helmet according to claim 16, wherein:

said second biasing means is a torsion coil spring.

18. A helmet according to claim 1, wherein:

said unlocking member moves in a forward direction to form an acute angle with respect to a downward moving direction of said subsidiary cap portion.

19. A helmet according to claim 18, wherein:

said acute angle falls within a range of 0° to 60°.

20. A helmet according to claim 18, wherein:

said acute angle falls within a range of 0° to 45°.

21. A helmet according to claim 18, wherein:

the forward moving direction of said unlocking member is inward the downward moving direction of said subsidiary cap portion, and said acute angle falls within a range of 0° to 45°.

22. A helmet including a cap-shaped head protecting body to be worn by a helmet wearer on his/her head, said head protecting body having a main cap portion and a subsidiary cap portion attached to said main cap portion to be substantially vertically movable so as to selectively cover a chin of the helmet wearer, said head protecting body being provided with first and second locking mechanisms for respectively locking left and right sides of said subsidiary cap portion with respect to said main cap portion when said subsidiary cap portion is at a lower position to cover the chin, and said head protecting body being also provided with a common unlocking member which is operated forward to commonly unlock said subsidiary cap portion locked by said first and second locking mechanisms, wherein:

a common tractive flexible wire is provided, said common tractive flexible wire commonly transmitting forward movement of said unlocking member to first and second movable locking members of said first and second locking mechanisms, one end portion of said wire is connected to said first movable locking member and the other end portion of said wire is connected to said second movable locking member, said unlocking member is provided with a wire engaging portion, an intermediate portion of said wire is engaged by said wire engaging portion, and a wire attaching member is attached to said unlocking member so that when said wire attaching member is slid with respect to said unlocking member, a position where said wire attaching member is attached on said unlocking member is adjusted, thereby removing slack from said wire.

23. A helmet according to claim 22, wherein:

a projection formed in one of said unlocking member and said wire attaching member, and a recess formed in the other one of said unlocking member and said wire attaching member are provided, and said projection is fitted in said recess to be linearly reciprocal relative to said recess, so that said wire attaching member is slidable with respect to said unlocking member.

* * * * *